US005360712A

United States Patent [19]

Olm et al.

[11] Patent Number: 5,360,712

[45] Date of Patent: Nov. 1, 1994

[54] INTERNALLY DOPED SILVER HALIDE EMULSIONS AND PROCESSES FOR THEIR PREPARATION

[75] Inventors: Myra T. Olm, Webster; Woodrow G. McDugle; Sherrill A. Puckett, both of Rochester; Traci Y. Kuromoto, West Henrietta; Raymond S. Eachus, Rochester; Eric L. Bell, Wesbter; Robert D. Wilson, Rochester, all of N.Y.

[73] Assignee: Eastman Kodak Company, Rochester, N.Y.

[21] Appl. No.: 91,148

[22] Filed: Jul. 13, 1993

[51] Int. Cl.[5] ..... G03C 1/08

[52] U.S. Cl. ..... 430/567; 430/569; 430/604; 430/605

[58] Field of Search ..... 430/567, 569, 604, 605

[56] References Cited

U.S. PATENT DOCUMENTS

| | | | |
|---|---|---|---|
| 3,672,901 | 6/1972 | Ohkubo et al. | 96/94 |
| 3,790,390 | 2/1974 | Shiba et al. | 96/125 |
| 3,890,154 | 6/1975 | Ohkubo et al. | 96/125 |
| 3,901,711 | 8/1975 | Iwaosa et al. | 96/95 |
| 4,092,171 | 5/1978 | Bigelow | 430/604 |
| 4,173,483 | 11/1979 | Habu et al. | 430/576 |
| 4,835,093 | 5/1989 | Janusonis et al. | 430/567 |
| 4,847,191 | 7/1989 | Grzeskowiak | 430/569 |
| 4,933,272 | 6/1990 | McDugle et al. | 430/567 |
| 4,937,180 | 1/1990 | Marchetti et al. | 430/567 |
| 4,945,035 | 7/1990 | Keevert, Jr. et al. | 430/567 |
| 4,981,781 | 1/1991 | McDugle et al. | 430/605 |
| 5,037,732 | 8/1991 | McDugle et al. | 430/567 |
| 5,132,203 | 7/1992 | Bell et al. | 430/567 |
| 5,268,264 | 12/1993 | Marchetti et al. | 430/605 |

FOREIGN PATENT DOCUMENTS

| | | | |
|---|---|---|---|
| 513748A1 | 11/1992 | European Pat. Off. | G03C 7/392 |

OTHER PUBLICATIONS

*Research Disclosure,* vol. 176, Dec. 1978, Item 17643, Section I, subsection A.

*Research Disclosure,* vol. 308, Dec. 1989, Item 308119, Section, I, subsection D.

*Primary Examiner*—Janet C. Baxter

*Attorney, Agent, or Firm*—Carl O. Thomas

[57] ABSTRACT

A process is disclosed of preparing a radiation sensitive silver halide emulsion comprising reacting silver and halide ions in a dispersing medium in the presence of a metal hexacoordination or tetracoordination complex having at least one organic ligand containing a least one carbon-to-carbon bond, at least one carbon-to-hydrogen bond, or at least one carbon-to-nitrogen-to-hydrogen bond sequence and at least half of the metal coordination sites occupied by halide or pseudohalide ligands. The metal forming the complex is chosen from periods 4, 5 and 6 and groups 3 to 13 inclusive of the periodic table of elements. The incorporation of the transition metal ion dopant and at least one organic ligand into the cubic crystal lattice of the silver halide grains can be used to improve photographic performance.

46 Claims, No Drawings

INTERNALLY DOPED SILVER HALIDE EMULSIONS AND PROCESSES FOR THEIR PREPARATION

FIELD OF THE INVENTION

The invention relates to photography. More specifically, the invention relates to photographic silver halide emulsions and to processes for their preparation.

BACKGROUND OF THE INVENTION a. Definition of Terms

All references to periods and groups within the periodic table of elements are based on the format of the periodic table adopted by the American Chemical Society and published in the *Chemical and Engineering News*, Feb. 4, 1985, p. 26. In this form the prior numbering of the periods was retained, but the Roman numeral numbering of groups and the A and B group designations (having opposite meanings in the U.S. and Europe) were replaced by a simple left to right 1 through 18 numbering of the groups.

The term "dopant" is employed herein to designate any element or ion other than silver or halide incorporated in a face centered silver halide crystal lattice.

The term "metal" in referring to elements includes all elements other than those of the following atomic numbers: 2, 5–10, 14–18, 33–36, 52–54, 85 and 86.

The term "Group VIII metal" refers to an element from period 4, 5 or 6 and any one of groups 8 to 10 inclusive.

The term "Group VIII noble metal" refers to an element from period 5 or 6 and any one of groups 8 to 10 inclusive.

The term "palladium triad metal" refers to an element from period 5 and any one of groups 8 to 10 inclusive.

The term "platinum triad metal" refers to an element from period 6 and any one of groups 8 to 10 inclusive.

The term "halide" is employed in its conventional usage in silver halide photography to indicate chloride, bromide or iodide.

The term "pseudohalide" refers to groups known to approximate the properties of halides—that is, monovalent anionic groups sufficiently electronegative to exhibit a positive Hammett sigma value at least equaling that of a halide—e.g., $CN^-$, $OCN^-$, $SCN^-$, $SeCN^-$, $TeCN^-$, $N_3^-$, $C(CN)_3^-$ and $CH^-$.

The term "C—C, H—C or C—N—H organic" refers to groups that contain at least one carbon-to-carbon bond, at least one carbon-to-hydrogen bond or at least one carbon-to-nitrogen-to-hydrogen bond sequence.

To avoid repetition, it is understood that all references to photographic emulsions are to negative-working photographic emulsions, except as otherwise indicated.

*Research Disclosure* is published by Kenneth Mason Publications, Ltd., Dudley House, 12 North St., Emsworth, Hampshire P010 7DQ, England.

b. Prior Art

*Research Disclosure,* Vol. 176, December 1978, Item 17643, Section I, sub-section A, states that "sensitizing compounds, such as compounds of copper, thallium, lead, bismuth, cadmium and Group VIII noble metals, can be present during precipitation of silver halide" emulsions. The quoted passage is followed by citations to demonstrate the general knowledge of the art that metals incorporated as dopants in silver halide grains during precipitation are capable of acting to improve grain sensitivity.

*Research Disclosure,* Vol. 308, December 1989, Item 308119, Section I, sub-section D, states that "compounds of metals such as copper, thallium, lead, mercury, bismuth, zinc, cadmium, rhenium, and Group VIII metals (e.g., iron, ruthenium, rhodium, palladium, osmium, iridium and platinum) can be present during the precipitation of silver halide" emulsions. The quoted passage is essentially cumulative with *Research Disclosure* 17643, Section I, sub-section A, except that the metals have been broadened beyond sensitizers to include those that otherwise modify photographic performance when included as dopants during silver halide precipitation.

*Research Disclosure* 308119, sub-section D, proceeds further to point out a fundamental change that occurred in the art between the 1978 and 1989 publication dates of these silver halide photography surveys. *Research Disclosure* 308118, I-D states further:

> The metals introduced during grain nucleation and/or growth can enter the grains as dopants to modify photographic properties, depending on their level and location within the grains. When the metal forms a past of a coordination complex, such as a hexacoordination complex or a tetracoordination complex, the ligands can also be occluded within the grains. Coordination ligands, such as halo, aguo, cyano, cyanate, thiocyanate, nitrosyl, thionitrosyl, oxo, and carbonyl ligands are contemplated and can be relied upon to vary emulsion properties further.

Although it was known for many years that the photographic performance of silver halide emulsions can be modified by the introduction of dopant metal ions during grain precipitation, it was generally assumed that the anion paired with the metal ion, except when it happened to be a halide ion, did not enter the grain structure and that the counterion selection was unrelated to photographic performance. Janusonis et al U.S. Pat. No. 4,835,093; McDugle et al U.S. Pat. Nos. 4,933,272, 4,981,781 and 5,037,732; Marchetti et al U.S. Pat. No. 4,937,180; and Keevert et al U.S. Pat. No. 4,945,035 were the first to demonstrate that ligands capable of forming coordination complexes with dopant metal ions are capable of entering the grain crystal structure and producing modifications of photographic performance that are not realized by incorporation of the transition metal ion alone. In each of these patents emphasis is placed on the fact that the coordination complex steric configuration allows the metal ion in the complex to replace a silver ion in the crystal lattice with the ligands replacing adjacent halide ions.

Thereafter, by hindsight, it was realized that earlier disclosures of the addition of dopant metal ions, either as simple salts or as coordination complexes, had inadvertently disclosed useful ligand incorporations. Of these inadvertent teachings, the incorporation of iron hexacyanide during grain precipitation is the most notable and is illustrated by Shiba et al U.S. Pat. No. 3,790,390; Ohkubo et al U.S. Pat. No. 3,890,154; Iwaosa et al U.S. Pat. No. 3,901,711 and Habu et al U.S. Pat. No. 4,173,483.

Ohya et al European patent application 0 513 748 A1, published Nov. 19, 1992, discloses photographic silver halide emulsions precipitated in the presence of a metal complex having an oxidation potential of from −1.34 V to +1.66 V and a reduction potential not higher than −1.34 V and chemically sensitized in the presence of a gold-containing compound. On page 2 of the patent a table of illustrative complexes satisfying the oxidation and reduction potentials are listed. This listing includes, in addition to the complexes consisting of halide and pseudohalide ligands, $K_2[Fe(EDTA)]$, where EDTA is an acronym for ethylenediaminetetraacetic acid. In a preferred variation it is taught to employ in combination with a required metal complex an iridium containing compound. Examples of useful iridium compounds include, in addition to simple halide salts and coordination complexes containing halide ligands, hexaamine iridium (III) salt (i.e., a $[(NH_3)_6Ir]^{+3}$ salt), hexaamine iridium (IV) salt (i.e., a $[(NH_3)_6Ir]^{+4}$ salt), a trioxalate iridium (III) salt and a trioxalate iridium (IV) salt. While offering a somewhat broader selection of ligands for use with the metals disclosed, Ohya et al does not attach any importance to ligand selection and does not address whether ligands are or are not incorporated into the grain structures during precipitation.

Ohkubo et al U.S. Pat. No. 3,672,901 (hereinafter designated Ohkubo et al '901) discloses silver halide precipitation in the presence of iron compounds. Ohkubo et al states, "Specific examples include: ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous sulfate, potassium hexacyanoferrate (II), potassium pentacyanoamine-ferrate (II), basic ferric acetate, ferric albuminate, ammonium ferric acetate, ferric bromide, ferric chloride, ferric chromate, ferric citrate, ferric fluoride, ferric formate, ferric glycero phosphate, ferric hydroxide, acidic ferric phosphate, sodium ferric ethylenedinitrilotetraacetate, sodium ferric pyrophosphate, ferric thiocyanate, ferric sulfate, ammonium ferric sulfate, guanidine ferric sulfate, ammonium ferric citrate, potassium hexacyanoferrate (III), tris(dipyridyl) iron (III) chloride, potassium ferric pentacyanonitrosyl, and hexaurea iron (III) chloride. The only compounds reported in the Examples are hexacyanoferrate (II) and (III) and ferric thiocyanate.

Hayashi U.S. Pat. No. 5,112,732 discloses useful results to be obtained in internal latent image forming direct positive emulsions precipitated in the presence of potassoium ferrocyanide, potassium ferricyanide or an EDTA iron complex salt. Doping with iron oxalate is demonstrated to be ineffective.

While the art has heretofore achieved useful photographic performance modifications through adding dopant metal salts and coordination complexes during grain precipitation, the photographic effects that have heretofore been achieved have been attributable to the dopant metal alone or to the metal dopant in combination with coordination complex ligands chosen from only a few restricted categories: halo, pseudohalo, aguo, nitrosyl, thionitrosyl, carbonyl and oxo ligands.

Prior to the present invention reported introductions during grain precipitation of metal coordination complexes containing organic ligands have not demonstrated photographically useful modifying effects attributable to the presence of the organic ligands, and, in fact, such coordination complexes have limited the photographic modifications that would be expected from introducing the metal in the form of a simple salt. Performance modification failures employing ethylenediamine and trioxalate metal coordination complexes of types analogous to those suggested by Ohya et al and Ohkubo et al '901 are presented below as comparative Examples.

SUMMARY OF THE INVENTION

The present invention has for the first time introduced during grain precipitation dopant metal coordination complexes containing one or more organic ligands and obtained modifications in photographic performance that can be attributed specifically to the presence of the organic ligand or ligands. The result is to provide the art with additional and useful means for tailoring photographic performance to meet specific application requirements.

In one aspect this invention is directed to a photographic silver halide emulsion comprised of radiation sensitive silver halide grains exhibiting a face centered cubic crystal lattice structure containing a metal ion dopant and from one to three C—C, H—C or C—N—H organic dopants, the metal ion dopant being chosen from periods 4, 5 and 6 and groups 3 to 14 inclusive of the periodic table of elements and the metal ion dopant and the one to three organic dopants being chosen from among those capable of forming a metal hexacoordination or tetracoordination complex in which one or more C—C, H—C or C—N—H organic ligands corresponding to the one to three C—C, H—C or C—N—H organic dopants occupy up to half the metal coordination sites in the coordination complex and at least half of the metal coordination sites in the coordination complex are occupied by halogen or pseudohalogen ligands.

In another aspect this invention is directed to a process of preparing a radiation-sensitive silver halide emulsion comprising reacting silver and halide ions in a dispersing medium in the presence of a metal hexacoordination or tetracoordination complex having at least one C—C, H—C or C—N—H organic ligand and at least half of the metal coordination sites occupied by halide or pseudohalide ligands, the metal forming the complex being chosen from periods 4, 5 and 6 and groups 3 to 14 inclusive of the periodic table of elements.

DESCRIPTION OF PREFERRED EMBODIMENTS

The present invention has achieved modifications of photographic performance that can be specifically attributed to the presence during grain precipitation of metal coordination complexes containing one or more C—C, H—C or C—N—H organic ligands. The photographic effectiveness of these organic ligand metal complexes is attributed to the recognition of criteria for selection never previously appreciated by those skilled in the art.

The complexes are chosen from among tetracoordination or hexacoordination complexes to favor steric compatibility with the face centered cubic crystal structures of silver halide grains. Metals from periods 4, 5 and 6 and groups 3 to 14 inclusive of the periodic table of elements are known to form tetracoordination and hexacoordination complexes and are therefore specifically contemplated. Preferred metals for inclusion in the coordination complexes are Group VIII metals. Non-noble Group VIII metals (i.e., the period 4 Group VIII metals) are contemplated for grain incorporation, with iron being a specifically preferred dopant metal. Noble Group VIII metals (those from the palladium and platinum triads) are contemplated, with ruthenium and rhodium being specifically preferred period 5 metal dopants and iridium being a specifically preferred period 6 dopant.

Further defining the coordination complexes are the ligands they contain. The coordination complexes contain a balance of halide and/or pseudohalide ligands (that is, ligands of types well known to be useful in photography) and C—C, H—C or C—N—H organic ligands. To achieve performance modification attributable to the presence of the C—C, H—C or C—N—H organic ligands at least half of the coordination sites provided by the metal ions must be satisfied by pseudohalide, halide or a combination of halide and pseudohalide ligands and at least one of the coordination sites of the metal ion must be occupied by an organic ligand. When the C—C, H—C or C—N—H organic ligands occupy all or even the majority of coordination sites in the complex, photographic modifications attributable to the presence of the C—C, H—C or C—N—H organic ligand have not been identified.

A surprising discovery has been that the selection of the C—C, H—C or C—N—H organic ligands is not limited by steric considerations in the manner indicated by Janusonis et al, McDugte et. al, Marchetti et al and Keevert et al, all cited above. Whereas each of these patents teach replacing a single halide ion the crystal lattice structure with a nonhalide ligand occupying exactly the same lattice position, C—C, H—C or C—N—H organic ligands of varied steric configurations have been observed to be effective. While it seems plausible that the smaller of these organic ligands lend themselves to one-for-one displacement of halide ions in the crystal lattice structure, the demonstration of the effectiveness of larger C—C, H—C or C—N—H organic ligands and C—C, H—C or C—N—H organic ligands of varied steric forms clearly demonstrates a much broader tolerance for geometrical configuration divergence of the host face centered cubic crystal lattice structure and the ligands of the metal dopant coordination complexes than had heretofore been thought feasible. In fact, the variation of steric forms of C—C, H—C or C—N—H organic ligands observed has led to the conclusion that neither the steric form nor size of the organic ligand is in itself a determinant of photographic utility.

Metal hexacoordination and tetracoordination complexes suitable for use in the practice of this invention have at least one C—C, H—C or C—N—H organic ligand and at least half of the metal coordination sites occupied by halide or pseudohalide ligands. A variety of such complexes are known. The specific embodiments are listed below. Formula acronyms are defined at their first occurrence.

MC-1

$[Sc(NCS)_3(py)_3]$
py = pyridine

Tris(pyridine)tris(thiocyanato) scandium (III) Reported by G. Wilkinson, R. D. Gillard and J. A. McCleverty (eds.), *Comprehensive Coordination Chemistry*, Pergamon 1987.

MC-2

$[M(Cl_3)(1,10\text{-phenanthroline})(H_2O)]$

-continued

M = La, Ce, Pr, Nd, Sa

Aguotrichloro (1,10-phenanthroline) lanthanide (III) Reported by F. A. Hart and F. P. Laming, *J. Inorg. Nucl. Chem.*, 26, 579 (1964).

MC-3

$(Et_4N)[TiCl_4(MeCN)_2]$
Et = ethyl, Me = methyl
Tetraethylammonium bis(acetonitrile) tetrachloro titanium (III)

Reported by B. T. Russ and G. W. A. Fowles, *Chem. Comm.*, 1, 19 (1966).

MC-4

$(R_4N)[TiCl_4(EtO)(MeCN)]$
EtO = $CH_3CH_2O$

MC-4a R = Me
Tetramethylammonium (acetonitrile) ethoxytetrachloro titanate (IV)

MC-4b R = Et
Tetraethylammonium (acetonitrile) ethoxytetrachloro titanate (IV)

a-b Reported by F. Von Adalbert, *Z. Anorg. Allgem. Chem.*, 338, 147 (1965).

MC-5

$(Et_4N)[TiCl_5(MeCN)]$
Tetraethylammonium (acetonitrile) pentachloro titanate (IV)

Reported by J. M. Kolthoff and F. G. Thomas, *J. Electrochem. Soc.*, 111, 1065 (1964).

MC-6

Pyridinium $[V(NCS)_4(py)_2]$
Pyridinium bis(pyridine) tetra(thiocyanato) vanadate (III)

Reported by R. J. H. Clark, *Comprehensive Inorganic Chemistry*, Vol. 3, pp. 544–545, edited by A. F. Trotman-Dickerson, Pergoman Press, Oxford, 1973 .

MC-7

$(Et_4N)[VCl_4(MeCN)_2]$
Tetraethylammonium bis(acetonitrile) tetrachloro vanadate (III)

Reported by R. J. H. Clark, *Comprehensive Inorganic Chemistry*, Vol. 3, pp. 544–545, editted by A. F. Trotman-Dickerson, Pergoman Press, Oxford, 1973.

MC-8

$[WCl_4(en)]$
en = ethylenediamine
(Ethylenediamine)tetrachloro tungsten (IV)

Reported by C. D. Kennedy and R. D. Peacock, *J. Chem. Soc.*, 3392 (1963).

MC-9

-continued

| | |
|---|---|
| | $(Bu_4N)[Cr(NCO)_4(en)]$<br>Bu = butyl<br>Tetrabutylammonium (ethylenediamine) tetra(cyanato) chromate (III) |

Reported by E. Blasius and G. Klemm, *Z. Anorg. Allgem. Chem.*, 428, 254 (1977).

| | |
|---|---|
| MC-10 | |
| | $(Bu_4N)[Cr(NCO)_4(1,2\text{-propanediamine})]$<br>Tetrabutylammonium tetra(cyanato) (1,2-propanediamine) chromate (III) |

Reported by E. Blasius and G. Klemm, *Z. Anorg. Allgem. Chem.*, 443, 265 (1978).

| | |
|---|---|
| MC-11 | |
| | $(Bu_4N)[Cr(NCO)_4(1,2\text{-cyclohexanediamine})]$<br>Tetrabutylammonium tetra(cyanato) (1,2-cyclohexanediamine) chromate (III) |

Reported by E. Blasius and G. Klemm, *Z. Anorg. Allgem. Chem.*, 443, 265 (1978).

| | |
|---|---|
| MC-12 | |
| | $[ReOCl_3(en)]$ |

Trichloro(ethylenediamine)oxo rhenium (V) Reported by D. E. Grove and G. Wilkinson, *J. Chem. Soc.* (*A*), 1224 (1966).

| | |
|---|---|
| MC-13 | |
| | $[ReI_4(py)_2]$ |

Tetraiodobis(pyridine) rhenium (IV) Reported by R. Colton, R. Levitus and G. Wilkinson, *J. Chem. Soc.*, 4121 (1960).

| | |
|---|---|
| MC-14 | |
| | $Na_3[Fe(CN)_5L]$ |
| MC-14a | L = (py)<br>Sodium pentacyano(pyridine) ferrate (II) |
| MC-14b | L = pyrazine = (pyz)<br>Sodium pentacyano(pyrazine) ferrate (II) |
| MC-14c | L = 4,4'-bipyridine<br>Sodium pentacyano(4,4' bipyridine) ferrate (II) |
| MC-14d | L = 3,3'-dimethyl-4,4'-bipyridine<br>Sodium pentacyano(3,3'-dimethyl 4,4'-bipyridine) ferrate (II) |
| MC-14e | L = 3,8-phenanthroline<br>Sodium pentacyano(3,8-phenanthroline) ferrate (II) |
| MC-14f | L = 2,7-diazapyrene<br>Sodium pentacyano(2,7-diazapyrene) ferrate (II) |
| MC-14g | L = 1,4-bis(4-pyridyl)butadiyne<br>Sodium pentacyano[1,4-bis(4-pyridyl)butadiyne] ferrate (II) |

a-g Reported by G-H. Lee, L. D. Ciana, A. Haim, *J. Am. Chem. Soc.*, 111, 1235-41 (1989).

-continued

| | |
|---|---|
| MC-14h | L = (4-py)pyridinium<br>Sodium pentacyano(4-pyridylpyridinium) ferrate (II) |
| MC-14i | L = 1-methyl-4-(4-py)pyridinium<br>Sodium pentacyano[1-methyl-4-(4-pyridyl)pyridium] ferrate (II) |
| MC-14j | L = N-Me-pyrazinium<br>Sodium pentacyano(N-methyl pyrazinium) ferrate (II) |
| MC-14k | L = 4-Cl(py)<br>Sodium pentacyano(4-chloro pyridino) ferrate (II) |

h-k Reported by H. E. Toma and J. M. Malin, *Inorg. Chem.* 12, 1039 (1973).

| | |
|---|---|
| MC-14l | L = $Ph_3P$<br>Ph = phenyl<br>Sodium pentacyano(tri phenylphosphine) ferrate (II) |

Reported by M. M. Monzyk and R. A. Holwerda, *Polyhedron*, 9, 2433 (1990).

| | |
|---|---|
| MC-14m | L = thiourea<br>Sodium pentacyano (thiourea) ferrate (II) |
| MC-14n | L = pyrazole<br>Sodium pentacyano (pyrazole) ferrate (II) |
| MC-14o | L = imidazole<br>Sodium pentacyano (imidazole) ferrate (II) |

m-o Reported by C. R. Johnson, W. W. Henderson and R. E. Shepherd, *Inorg. Chem.*, 23, 2754 (1984).

| | |
|---|---|
| MC-14p | L = $MeNH_2$<br>Sodium pentacyano (methylamine) ferrate (II) |
| MC-14q | L = $Me_2NH$<br>Sodium pentacyano (dimethylamine) ferrate (II) |
| MC-14r | L = $Me_3NH$<br>Sodium pentacyano (trimethylamine) ferrate (II) |
| MC-14s | L = $EtNH_2$<br>Sodium pentacyano (ethylamine) ferrate (II) |
| MC-14t | L = $BuNH_2$<br>Sodium pentacyano (butylamine) ferrate (II) |
| MC-14u | L = cyclohexylamine<br>Sodium pentacyano (cyclohexylamine) ferrate (II) |
| MC-14v | L = piperidine<br>Sodium pentacyano (piperidine) ferrate (II) |
| MC-14w | L = aniline<br>Sodium pentacyano (aniline) ferrate (II) |
| MC-14x | L = morpholine<br>Sodium pentacyano (morpholine) ferrate (II) |
| MC-14y | L = ethanolamine<br>Sodium pentacyano (ethanolamine) ferrate (II) |

p-y Reported by N. E. Klatz, P. J. Aymoneno, M. A. Blesa and J. A. Olabe, *Inorg. Chem.* 17, 556 (1978).

| | |
|---|---|
| MC-14z | L = $P(OBu)_3$<br>Sodium pentacyano(tributyl-phosphite) ferrate (II) |

-continued

| | |
|---|---|
| MC-14aa | L = $P(Bu)_3$<br>Sodium pentacyano[(tri butyl)phosphine] ferrate (II) |

z-aa Reported by V. H. Inouye, E. Fluck, H. Binder and S. Yanagisawa, *Z. Anorg. Allgem. Chem.*, 483, 75–85 (1981).

| | |
|---|---|
| MC-14bb | L = p-nitroso-N,N-dimethylaniline<br>Sodium pentacyano(p-nitroso N,N-dimethylaniline) ferrate (II) |
| MC-14cc | L = nitrosobenzene<br>Sodium pentacyano(nitroso benzene) ferrate (II) |
| MC-14dd | L = 4-CN-(py)<br>Sodium pentacyano(4-cyano pyridine) ferrate (II) |

bb-dd Reported by Z. Bradic, M. Pribanic and S. Asperger, *J. Chem. Soc.*, 353 (1975).

| | |
|---|---|
| MC-14ee | L = 3-[$(H_5C_2)_2NC(O)$](py)<br>Sodium pentacyano-(nicotinamide) ferrate (II) |
| MC-14ff | L = 4-[$NH_2NHC(O)$](py)<br>Sodium pentacyano(iso nicotinoylhydrazine) ferrate (II) |
| MC-14gg | L = 3-CHO-(py)<br>Sodium pentacyano (nicotinaldehyde) ferrate (II) |
| MC-14hh | L = 3-[$NH_2C(O)$](py)<br>Sodium pentacyano (nicotinamide) ferrate (II) |
| MC-14ii | L = 4-[$NH_2C(O)$](py)<br>Sodium pentacyano(iso nicotinamide) ferrate (II) |
| MC-14jj | L = 3-[$^{-}OC(O)$](py)<br>Sodium pentacyano (nicotinato) ferrate (II) |
| MC-14kk | L = 4-[$^{-}OC(O)$](py)<br>Sodium pentacyano(iso-nicotinato) ferrate (II) |
| MC-14ll | L = 3-[$^{-}OC(O)CH_2NHC(O)$](py)<br>Sodium pentacyano(nico-tinoylglycinato) ferrate (II) |
| MC-14mm | L = [$H_2NC(O)$](pyz)<br>Sodium pentacyano(pyrazine amide) ferrate (II) |
| MC-14nn | L = (pyz)-mono-N-oxide<br>Sodium pentacyano(pyrazine mono-N-oxide) ferrate (II) |

ee-nn Reported by P. J. Morando, U. I. E, Bruyere and M. A. Blesa, *Transition Metal Chem.* , 8, 99 (1983).

| | |
|---|---|
| MC-14oo | L = 4-Ph(py)<br>Sodium pentacyano(4-phenyl pyridine) ferrate (II) |
| MC-14pp | L = pyridazine<br>Sodium pentacyano (pyridazine) ferrate (II) |
| MC-14qq | L = pyrimidine<br>Sodium pentacyano (pyrimidine) ferrate (II) |

oo-qq Reported by D. K. Lavallee and E. B. Fleischer, *J. Am. Chem. Soc.*, 94 (8), 2583 (1972).

| | |
|---|---|
| MC-14rr | L = $Me_2SO$<br>Sodium pentacyano(dimethyl sulfoxide) ferrate (II) |

-continued

Reported by H. E. Toma, J. M. Malin and E. Biesbrecht, *Inorg. Chem.*, 12, 2884 (1973).

| | |
|---|---|
| MC-15 | $K_3[Ru(CN)_5L]$ |
| MC-15a | L = (pyz)<br>Potassium pentacyano (pyrazine) ruthenate (II) |

Reported by C. R. Johnson and R. E. Shepherd, *Inorg. Chem.*, 22, 2439 (1983).

| | |
|---|---|
| MC-15b | L = methylpyrazinium<br>Potassium pentacyano (methylpyrazinium) ruthenate (II) |
| MC-15c | L = imidazole<br>Potassium pentacyano (imidazole) ruthenate (II) |
| MC-15d | L = 4-pyridylpyridinium<br>Potassium pentacyano (4-pyridylpyridinium) ruthenate (II) |
| MC-15e | L = 4,4'-bipyridine<br>Potassium pentacyano (4,4'-bipyridine) ruthenate (II) |
| MC-15f | L = $Me_2SO$<br>Potassium pentacyano (dimethylsulfoxide) ruthenate (II) |
| MC-15g | L = (py)<br>Potassium pentacyano (pyridine) ruthenate (II) |
| MC-15h | L = 4-[$^{-}OC(O)$](py)<br>Potassium pentacyano-(isonicotinato) ruthenate (II) |

b-h Reported by M. A. Hoddenbagh and D. A. McCartney, *Inorg. Chem.*, 25, 2099 (1986).

| | |
|---|---|
| MC-16 | $[CoX_2(MeCN)_2]$<br>X = $Cl^-$, $Br^-$ or $NCS^-$ |
| MC-16a | X = $Cl^-$<br>Bis(acetonitrile) dichloro cobalt (II) |
| MC-16b | X = $Br^-$<br>Bis(acetonitrile) dibromo cobalt (II) |
| MC-16a | X = $Cl^-$<br>Bis(acetonitrile) bis(thiocyanato) cobalt (II) |

Reported by G. Beech and G. Marr, *J. Chem. Soc.*, (*A*) 2904 (1970).

| | |
|---|---|
| MC-17 | $[CoCl_3(PhCN)]$<br>(Benzonitrile)trichloro cobalt (III) |

Reported by G. Beech and G. Marr, *J. Chem. Soc.*, (*A*) 2904 (1970).

| | |
|---|---|
| MC-18 | $K_2[Co(CN)_5L]$ |
| MC-18a | L = Me<br>Potassium pentacyano(methyl) cobaltate (III) |
| MC-18b | L = Et<br>Potassium pentacyano(ethyl) |

-continued

| | |
|---|---|
| | cobaltate (III) |
| MC-18c | L = tolyl<br>Potassium pentacyano(tolyl)<br>cobaltate (III) |
| MC-18d | L = acetamide<br>Potassium pentacyano(acetamide)<br>cobaltate (III) |
| MC-18e | L = $—CH_2C(O)O^-$<br>Potassium pentacyano(acetato)<br>cobaltate (III) |
| MC-18f | L = $—CH_2C(O)OCH_3$<br>Potassium pentacyano(methyl<br>acetato) cobaltate (III) |
| MC-18g | L = $—CH_2CH_2C(O)OCH_3Me$<br>Potassium pentacyano(methyl<br>proponato) cobaltate (III) |

a-g Reported by J. Halpern and J. P. Maher, *J. Am. Chem. Soc.*, 87, 5361 (1965).

| MC-19 | |
|---|---|
| | $K[Co(CN)_4(en)]$<br>Potassium tetracyano<br>(ethylenediamine) cobaltate (III) |

Reported by K. Ohkawa, J. Fujita and Y. Shimura, *Bulletin of the Chemical Society of Japan,* 42, 3184-9 (1969).

| MC-20 | |
|---|---|
| | $Ba[Co(CN)_4(tn)]$<br>(tn) = trimethylenediamine<br>Barium tetracyano<br>(trimethylenediamine) cobaltate (III) |

Reported by K. Ohkawa, J. Fujita and Y. Shimura, *Bulletin of the Chemical Society of Japan,* 42, 3184-9 (1969).

| MC-21 | |
|---|---|
| | $[RhL_3Cl_3]$ |
| MC-21a | L = MeCN<br>Tris(acetonitrile)<br>trichloro rhodium (III) |
| MC-21b | L = PhCN<br>Tris(benzonitrile)<br>trichloro rhodium (III) |

a-b Reported by G. Beech and G. Mart, *J. Chem. Soc.* (*A*), 2904 (1970).

| MC-22 | |
|---|---|
| | $Na_2[RhCl_5(SMe_2)]$<br>Sodium pentachloro(di<br>methylsulfide) rhodate (III) |

Reported by S. J. Anderson, J. R. Barnes, P. L. Goggin and R. S. Goodfellow, *J. Chem. Res.* (*M*), 3601 (1978).

| MC-23 | |
|---|---|
| | cis,trans-$[RhX_4(SMe_2)_2]$<br>X = halo<br>cis or trans-Tetrahalobis<br>(dimethylsulfide) rhodate (III) |

Reported by S. J. Anderson, J. R. Barnes, P. L. Goggin and R. S. Goodfellow, *J. Chem. Res.* (*M*), 3601 (1978).

| MC-24 | |
|---|---|
| | mer,fac-$[RhX_3(SMe_2)_3]$<br>met or fac-Trihalotris(di-<br>methylsulfide) rhodate (III) |

Reported by S. J. Anderson, J. R. Barnes, P. L. Goggin and R. S. Goodfellow, *J. Chem. Res.* (*M*), 3601 (1978).

| MC-25 | |
|---|---|
| | cis,trans-$[N(C_3H_7)_4][RhCl_4(Me_2SO)_2]$<br>Tetrapropylammonium tetrachloro<br>bis(dimethylsulfoxide) rhodium (III) |

Reported by Y. N. Kukushkin, N. D. Rubtsora and N. Y. Irannikova, Russ. *J. Inorg. Chem.* (Trans. Ed.), 15, 1032 (1970).

| MC-26 | |
|---|---|
| | $[RhCl_3(Me_2SO)_3]$<br>Trichlorotris(di<br>methylsulfoxide) rhodium (III) |

Reported by Y. N. Kukushkin, N. D. Rubtsora and N. Y. Irannikova, Russ. J. Inorg. Chem. (Trans. Ed.), 15, 1032 (1970).

| MC-27 | |
|---|---|
| | $K[RhCl_4L]$ |
| MC-27a | L = 1,10-phenanthroline<br>Potassium tetrachloro(1,10-<br>phenanthroline) rhodate (III) |
| MC-27b | L = 5-methyl(1,10-phenanthroline)<br>Potassium tetrachloro[5-methyl(1,10-<br>phenanthroline)] rhodate (III) |
| MC-27c | L = 5,6-dimethyl(1,10-phenanthroline)<br>Potassium tetrachloro[5,6-dimethyl<br>(1,10-phenanthroline)] rhodate (III) |
| MC-27d | L = 5-bromo(1,10-phenanthroline)<br>Potassium tetrachloro[5-bromo(1,10-<br>phenanthroline)] rhodate (III) |
| MC-27e | L = 5-chloro(1,10-phenanthroline)<br>Potassium tetrachloro[5-chloro(1,10-<br>phenanthroline)] rhodate (III) |
| MC-27f | L = 5-nitro(1,10-phenanthroline)<br>Potassium tetrachloro[5-nitro(1,10-<br>phenanthroline)] rhodate (III) |
| MC-27g | L = 4,7-diphenyl(1,10-phenanthroline<br>Potassium tetrachloro(1,10-<br>phenanthroline) rhodate (III) |

a-g Reported by R. J. Watts and J. Van Houten, *J. Am. Chem. Soc.*, 96, 4334 (1974).

| MC-28 | |
|---|---|
| | $K[IrX_4(en)]$ |
| MC-28a | X = Cl<br>Potassium tetrachloro(ethyl<br>enediamine) iridate (III) |
| MC-28b | X = Br<br>Potassium tetrabromo(ethyl<br>enediamine) iridate (III) |

a-b Reported by I. B. Barnovskii, R. E. Sevast'ynova, G. Y. Mazo and V. I. Nefadov, *Russ. J. of Inorg. Chem.*, (Trans. Ed.) 19, 1974.

| | |
|---|---|
| MC-29 | |
| | $K[IrCl_x(MeCN)_y]$ |
| MC-29a | x = 4, y = 2<br>Potassium tetrachloro<br>bis(acetonitrile) iridate (III) |
| MC-29b | x = 5, y = 1<br>Potassium pentachloro<br>(acetonitrile) iridate (III) |

a-b Reported by B. D. Catsikis and M. L. Good, *Inorg. Nucl. Chem. Lett.*, 9, 1129-30 (1973).

| | |
|---|---|
| MC-30 | |
| | $[N(Me)_4][IrCl_4(MeSCH_2CH_2SMe)]$<br>Tetramethylammonium tetrachloro<br>(2,5-dithiahexane) iridate (III) |

Reported by D. J. Gulliver, W. Levason, K. G. Smith and M. J. Selwood, *J. Chem. Soc.* Dalton trans, 1872-8 (1980).

| | |
|---|---|
| MC-31 | |
| | $K_m[IrX_x(pyz)_yL_n]$ |
| MC-31a | X = Cl, m = 2, n = 0, x = 5, y = 1<br>Potassium pentachloro<br>(pyrazine) iridate (III) |
| MC-31b | X = Cl, m = 1, n = 0, x = 4,<br>y = 2, cis isomer<br>Potassium tetrachloro<br>biscis(pyrazine) iridate (III) |
| MC-31c | x = Cl, m = 1, n = 0, x = 4,<br>y = 2, trans isomer<br>Potassium tetrachloro<br>bistrans(pyrazine) iridate (III) |
| MC-31d | X = Cl, m = 1, n = 0, x = 3, y = 3<br>Potassium trichloro<br>tris(pyrazine) iridate (III) |

a-d Reported by F. Lareze, *C. R. Acad. Sc. Paris,* 261, 3420 (1965).

| | |
|---|---|
| MC-32 | |
| | $K_2[IrCl_5(pyrimidine)]$<br>Potassium pentachloro<br>(pyrimidine) iridate (III) |

Reported by F. Larese and L. Bokobza-Sebagh, *C. R. Acad. Sc. Paris,* 277 , 459 (1973).

| | |
|---|---|
| MC-33 | |
| | $K_4[Ir_2Cl_{10}(pyz)]$<br>Potassium decachloro<br>($\mu$-pyrazine) bis[pentachloroiridate (III)] |

Reported by F. Lareze, *C. R. Acad. Sc. Paris,* 282, 737 (1976).

| | |
|---|---|
| MC-34 | |
| | $K_m[IrCl_x(py)_yL_n]$ |
| MC-34a | m = 2, n = 0, x = 5, y = 1<br>Potassium pentachloro<br>(pyridine) iridate (III) |
| MC-34b | m = 1, n = 0, x = 4, y = 2<br>Potassium tetrachloro<br>bis(pyridine) iridate (III) |
| MC-34c | m = 0, n = 0, x = 3, y = 3<br>Trichlorotris(pyridine)<br>iridate (III) |
| MC-34d | L = pyridazine, m = 0, n = 1,<br>x = 5, y = 0<br>Potassium pentachloro-<br>(pyridazine) iridate (III) |

a-d Reported by G. Rio and F. Larezo, *Bull Soc. Chim. France,* 2393 (1975).

| | |
|---|---|
| MC-34e | L = $(C_2O_4)$, m = 2, n = 1, x = 3, y = 1<br>Potassium trichloro(oxalate)<br>(pyridine) iridate (III) |

Reported by Y. Inamura, *Bull. Soc. China,* 7, 750 (1940).

| | |
|---|---|
| MC-34f | L = (HOH), m = 0, n = 1, x = 3, y = 2<br>Trichloromonoaquo-<br>(pyridine iridium (III) |

Reported by M. Delepine, *Comptes Rendus,* 200, 1373 (1935).

| | |
|---|---|
| MC-35 | |
| | $K_3[IrCl_4(C_2O_4)]$<br>Potassium tetrachloro<br>oxalato iridate (III) |

Reported by A. Duffour, *Comptes Rendus,* 152, 1393 (1911).

$[(PhCH_2)Ph_3P]_2$ MC-36

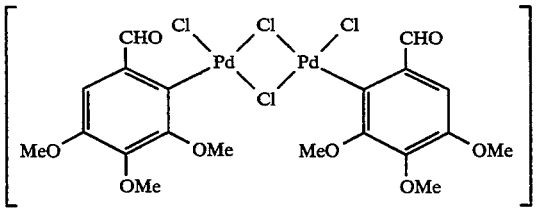

Reported by J. Vincente, J-A. Abad and P. G. Jones, *Organometallics,* 11, 31512 (1992).

| | |
|---|---|
| MC-37 | |
| | $[Pd(LCN)_2Cl_2]$ |
| MC-37a | L = Me<br>Bis(acetonitrile)dichloro<br>palladium (II) |
| MC-37b | L = Ph<br>Dichlorobis(phenylcyano)<br>palladium (II) |

Reported by G. Beech and G. Marr, *J. Chem. Soc. (A),* 2904 (1970).

| | |
|---|---|
| MC-38 | |
| | $K[PtCl_3(C_2H_4)]$<br>Potassium trichloroethylene<br>platinate (II) |

Reported by R. G. Buy and B. L. Shaw, *Advanc. Inorg. Chem. Radiochem.,* 4, 77 (1962).

MC-39

$K[PtCl_3(C_4H_8)]$
Potassium butylenetrichloro
platinum (II)

Reported by H. P. Fritz, K. E. Schwazhans and D. Silman, *J. Organmet. Chem.*, 6, 551 (1966).

MC-40

$[Pt(PhCN)_2Cl_2]$
Dichlorobis(phenylcyano)
platinum (II)

Reported by G. Beech and G. Mart, *J. Chem. Soc. (A)*, 2904 (1970).

MC-41

$[Cu(2\text{-methylpyridine})_2Cl_2]$
Dichlorobis(2-methylpyridine)
copper (II)

Reported by V. F. Duckworth, D. P. Graddon, N. C. Stephenson and E. C. Walton, *Inorg. Nucl. Chem. Lett.*, 3, 557 (1967).

MC-42

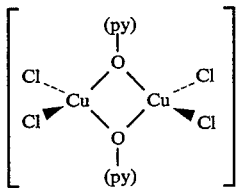

Tetrachloro,di-μ-(pyridine-N-oxide)
dicopper (II)

Reported by H. L. Schaffer, J. C. Morrow and H. M. Smith, *J. Chem. Phys.*, 42, 504 ( 1965 ) and R. S. Sager, R. J. Williams and W. H. Watson, *Inorg. Chem.*, 6, 541 (1967).

MC-43

$[CdCl_2(thiourea)_2]$
Dichlorobisthiourea
cadmium (II)

Reported by M. Nardelli, G. Fava and P. Boldrini, *Gazz. Chim. Ital.*, 92, 1392 (1962).

MC-44

$[Cd(NCS)_2(ethylenethiourea)_2]$
Bis(ethylenethiourea)
bis(isothiocyanato) cadmium (II)

Reported by L. Cavalea, M. Nardelli and G. Fava, *Acta Cryst.*, 13, 125 (1960).

MC-45

$[In(thiourea)_3(NCS)_3]$
Tris(isothiocyanato)
trithiourea indium (III)

Reported by S. J. Patel, D. B. Sowerby and D. G. Tuck, *J. Chem. Soc. (A)* , 1188 (1967).

MC-46

$[In(dimac)_3(NCS)_3]$
dimac = N,N-dimethylacetamide
Tris(N,N-dimethylacetamide)
tris(isothiocyanato) indium (III)

Reported by S. J. Patel, D. B. Sowerby and D. G. Tuck, *J. Chem. Soc. (A)*, 1188 (1967).

MC-47

$[Et_4N]_2[Me_mSn(SCN)_n]$

MC-47a m = 2, n = 4
Tetraethylammonium dimethyl
tetra(isothiocyanato) stannate

MC-47b m = 1, n = 5
Tetraethylammonium methyl
penta(isothiocyanato) stannate a-b Reported by A. Cassal, R. Portanova and Barbieri, *J. Inorg. Nucl. Chem.*, 27, 2275 (1965).

MC-48

$Na_6[Fe_2(CN)_{10}(pyz)]$
Sodium decacyano(μ-pyrazine)
diferrate (II)

Reported by J. M. Malin, C. F. Schmitt, H. E . Toma, *Inorg. Chem.*, 14, 2924 (1975).

MC-49

$Na_6[Fe_2(CN)_{10}(\mu\text{-}4,4'\text{-bipyridine})]$
Sodium decacyano(μ-4,4'-bipyridine)
diferrate (II)

Reported by J. E. Figard, J. V. Paukstelis, E. F. Byrne and J. D. Peterson, *J. Am. Chem. Soc.*, 99, 8417 (1977).

MC-50

$Na_6[Fe_2(CN)_{10}L]$
L = trans-1,2-bis(4-pyridyl)ethylene
Sodium decacyano[μ-trans-1,2-
bis(4-pyridyl)ethylene]
diferrate (II)

Reported by N. E. Katz, *An. Quim. Ser. B*, 77 (2), 154-6.

MC-51

$Na_5[(CN)_5FeLCo(CN)_5]$

MC-51a L = (pyz)
Sodium decacyano(μ-pyrazine)
ferrate (II) cobaltate (III)

MC-51b L = 4,4'-bipyridine
Sodium decacyano(μ-4,4'-bipyridine)
ferrate (II) cobaltate (III)

MC-51c L = 4-cyanopyridine
Sodium decacyano(μ-4-cyanopyridine)
ferrate (II) cobaltate (III)

Reported by K. J. Pfenning, L. Lee, H. D. Wohlers and J. D. Peterson, *Inorg. Chem.*, 21, 2477 (1982).

In addition to the illustrative known compounds, compounds not located in the literature have been synthesized and employed in the practice of the invention. These compounds include the following:

| | |
|---|---|
| MC-52 | $K_2[IrCl_5(thiazole)]$<br>Potassium pentchloro<br>(thiazole) iridate (III) |
| MC-53 | $Na_3K_2[IrCl_5(pyz)Fe(CN)_5]$<br>Potassium sodium<br>pentachloro iridate (III)<br>($\mu$-pyrazine) pentacyano ferrate (II) |
| MC-54 | $K_5[IrCl_5(pyz)Ru(CN)_5]$<br>Potassium pentachloro<br>iridate (III) ($\mu$-pyrazine)<br>pentacyano ruthenate (II) |
| MC-55 | $Na_3K_3[Fe(CN)_5(pyz)Ru(CN)_5]$<br>Potassium sodium<br>decacyano($\mu$-pyrazine)<br>ferrate (II) ruthenate (II) |
| MC-56 | $K_2[Rh(CN)_5(thiazole)]$<br>Potassium pentacyano<br>(thiazole) rhodate (III) |
| MC-57 | $Na_4[Rh_2Cl_{10}(pyz)]$<br>Sodium decachloro<br>(pyrazine) rhodate (III) |
| MC-58 | $Rh[Cl_3(oxazole)_3]$<br>Trichloro<br>tris(oxazole) rhodium (III) |
| MC-59 | $Na_3[Fe(CN)_5TQ]$<br>TQ = (5-triazolo[4,3-a]quinoline)<br>Sodium pentacyano(5-triazolo<br>[4,3-a]quinoline) ferrate (II) |

Preparations of these compounds are presented below.

Generally any C—C, H—C, or C—N—H organic ligand capable of forming a dopant metal tetracoordination or hexacoordination complex with at least half of the metal coordination sites occupied by halide or pseudohalide ligands can be employed. This, of course, excludes coordination complexes such as metal ethylenediaminetetraacetic acid (EDTA) complexes, since EDTA itself occupies six coordination sites and leaves no room for other ligands. Similarly, tris(oxalate) and bis(oxalate) metal coordination complexes occupy too many metal coordination sites to allow the required inclusion of other ligands.

By definition, to be considered C—C, H—C or C—N—H organic a ligand must include at least one carbon-to-carbon bond, at least one carbon-to-hydrogen bond or at least one hydrogen-to-nitrogen-to-carbon bond linkage. A simple example of a C—C, H—C or C—N—H organic ligand classifiable as such solely by reason of containing a carbon-to-carbon bond is an oxalate (—O(O)C—C(O)O—) ligand. A simple example of a C—C, H—C or C—N—H organic ligand classifiable as such solely by reason of containing a carbon-to-hydrogen bond is a methyl (—$CH_3$) ligand. A simple example of a C—C, H—C or C—N—H organic ligand classifiable as such solely by reason of containing a hydrogen-to-nitrogen-to-carbon bond linkage is a ureido [—HN—C(O)—NH—] ligand. All of these ligands fall within the customary contemplation of organic ligands. The C—C, H—C or C—N—H organic ligand definition excludes compounds lacking organic characteristics, such as ammonia, which contains only nitrogen-to-hydrogen bonds, and carbon dioxide, which contains only carbon-to-oxygen bonds.

The realization of useful photographic performance modifications through the use of C—C, H—C or C—N—H organic ligands is based on performance comparisons and is independent of any particular theory. By comparing the C—C, H—C or C—N—H organic ligand definition bonding requirements with the bonds present in ligands heretofore reported to have been incorporated in silver halide grain structures, it is recognized that the definitionally required bonding present in the C—C, H—C or C—N—H organic ligands differentiates them structurally from known ligand dopants. The balancing of halide and pseudohalide ligands with one or more organic ligands to achieve useful photographic effects is consistent with the halide and pseudohalide ligands occupying halide ion lattice sites in the crystal structure. On the other hand, the diversity of size and steric forms of the organic ligands shown to be useful supports the position that photographic effectiveness extends beyond the precepts of prior substitutional models. It is now specifically contemplated that C—C, H—C or C—N—H organic ligand effectiveness can be independent of size or steric configuration and is limited only by their availability in metal dopant ion tetracoordination or hexacoordination complexes. Nevertheless, since there is no known disadvantage for choosing organic ligands based on host crystal lattice steric compatibility or approximations of steric compatibility nor have any advantages been identified for increasing ligand size for its own sake, the preferred organic ligand selections discussed below are those deemed most likely to approximate host crystal lattice compatibility. In other words, while the precept of host crystal lattice matching as an essential prerequisite of ligand utility has been discredited, there are significant advantages to be gained by selecting C—C, H—C or C—N—H organic ligands on the basis of their exact or approximate conformation to the host crystal lattice.

In general preferred individual C—C, H—C or C—N—H organic ligands contain up to 24 (optimally up to 18) atoms of sufficient size to occupy silver or halide ion sites within the grain structure. Stated another way, these organic ligands preferably contain up to 24 (optimally up to 18) nonmetallic atoms. Since hydrogen atoms are sufficiently small to be accommodated interstitially within a silver halide face centered cubic crystal structure, the hydrogen content of the organic ligands poses no selection restriction. While these organic ligands can contain metallic ions, these also are readily sterically accommodated within the crystal lattice structure of silver halide, since metal ions are, in general, much smaller than nonmetallic ions of similar atomic number. For example, silver ion (atomic number 47) is much smaller than bromide ion (atomic number 35). In the overwhelming majority of instances these organic ligands consist of hydrogen and nonmetallic atoms selected from among carbon, nitrogen, oxygen, fluorine, sulfur, selenium, chlorine and bromine. The steric accommodation of iodide ions within silver bromide face centered cubic crystal lattice structures is well known in photography. Thus, even the heaviest non-metallic atoms, iodine and tellurium, can be included within the organic ligands, although their occurrence is preferably limited (e.g., up to 2 and optimally only 1) in any single organic ligand.

Referring to the illustrations of C—C, H—C or C—N—H organic ligand containing coordination complexes above, it is apparent that a wide variety of organic ligands are available for selection. C—C, H—C or C—N—H organic ligands can be selected from among a wide range of organic families, including substituted and unsubstituted aliphatic and aromatic hydrocarbons, secondary and tertiary amines (including diamines and hydrazines), phosphines, amides (including hydrazides), imides, nitriles, aldehydes, ketones, organic acids (including free acids, salts and esters), sulfoxides, and aliphatic and aromatic heterocycles including chalcogen (i.e., oxygen, sulfur, selenium and tellurium) and pnictide (particularly nitrogen) hetero ring atoms. The following are offered as nonlimiting illustrations of preferred C—C, H—C or C—N—H organic ligand categories:

Aliphatic hydrocarbon ligands containing up to 10 (most preferably up to 6) nonmetallic (e.g., carbon) atoms, including linear, branched chain and cyclic alkyl, alkenyl, dialkenyl, alkynyl and dialkynyl ligands.

Aromatic hydrocarbon ligands containing 6 to 14 ring atoms (particularly phenyl and naphthyl).

Aliphatic azahydrocarbon ligands containing up to 708 nonmetallic (e.g., carbon and nitrogen) atoms. The term "azahydrocarbon" is employed to indicate nitrogen atom substitution for at least one, but not all, of the carbon atoms. The most stable and hence preferred azahydrocarbons contain no more than one nitrogen-to-nitrogen bond. Both cyclic and acyclic azahydrocarbons are particularly contemplated.

Aliphatic and aromatic nitriles containing up to 14 carbon atoms, preferably up to 6 carbon atoms.

Aliphatic ether and thioether ligands, the latter also being commonly named as thiahydrocarbons in a manner analogous to azahydrocarbon ligands. Both cyclic and acyclic ethers and thioethers are contemplated.

Amines, including diamines, most preferably those containing up to 12 (optimally up to 6) nonmetal (e.g., carbon) atoms per nitrogen atom organic substituent. Note that the amines must be secondary or tertiary amines, since a primary amine ($H_2N$—), designated by the term "amine" used alone, does not satisfy the organic ligand definition.

Amides, most preferably including up to 12 (optimally up to 6) nonmetal (e.g., carbon) atoms.

Aldehydes, ketones, carboxylates, sulfonates and phosphonates (including mono and dibasic acids, their salts and esters) containing up to 12 (optimally up to 7) nonmetal (e.g., carbon) atoms.

Aliphatic sulfoxides containing up to 12 (preferably up to 6) nonmetal (e.g., carbon) atoms per aliphatic moiety.

Aromatic and aliphatic heterocyclic ligands containing up to 18 ring atoms with heteroatoms typically being selected from among pnictides (e.g., nitrogen) and chalcogens (e.g., oxygen, sulfur, selenium and tellurium). The heterocylic ligands contain at least one five or six membered heterocyclic ring, with the remainder of the ligand being formed by ring substituents, including one or more optional pendant or fused carbocyclic or heterocyclic rings. In their simplest form the heterocycles contain only 5 or 6 non-metallic atoms. Exemplary nonlimiting illustrations of heterocyclic ring structures include furans, thiophenes, azoles, diazoles, triazoles, tetrazoles, oxazoles, thiazoles, imidazoles, azines, diazines, triazines, as well as their bis (e.g., bipyridine) and fused ring counterparts (e.g, benzo- and naptho- analogues). When a nitrogen hetero atom is present, each of trivalent, protonated and quaternized forms are contemplated. Among specifically preferred heterocyclic ring moieties are those containing from 1 to 3 ring nitrogen atoms and azoles containing a chalcogen atom.

All of the above C—C, H—C or C—N—H organic ligands can be either substituted or unsubstituted. Any of a broad range of stable and synthetically convenient substituents are contemplated. Halide, pseudohalide, hydroxyl, nitro and organic substituents that are linked directly or through divalent oxygen, sulfur or nitrogen linkages are specifically contemplated, where the organic substituents can be simple or composite forms of the types of organic substituents named above.

The requirement that at least one of the coordination complex ligands be a C—C, H—C or C—N—H organic ligand and that half of the ligands be halide or pseudohalide ligands permits one of the ligands in tetracoordination complexes and one or two of the ligands in hexacoordination complexes to be chosen from among ligands other than C—C, H—C or C—N—H organic, halide and pseudohalide ligands. For example, nitrosyl (NO), thionitrosyl (NS), carbonyl (CO), oxo (O) and aquo (HOH) ligands are all known to form coordination complexes that have been successfully incorporated in silver halide grain structures. These ligands are specifically contemplated for inclusion in the coordination complexes satisfying the requirements of the invention.

In general any known dopant metal ion coordination complex containing the required balance of halo and/or pseudohalo ligands with one or more C—C, H—C or C—N—H organic ligands can be employed in the practice of the invention. This, of course, assumes that the coordination complex is structurally stable and exhibits at least very slight water solubility under silver halide precipitation conditions. Since silver halide precipitation is commonly practiced at temperatures ranging down to just above ambient (e.g., typically down to about 30° C.), thermal stability requirements are minimal. In view of the extremely low levels of dopants that have been shown to be useful in the art only extremely low levels of water solubility are required.

The organic ligand containing coordination complexes satisfying the requirements above can be present during silver halide emulsion precipitation in any conventional level known to be useful for the metal dopant ion. Evans U.S. Pat. No. 5,024,931, discloses effective doping with coordination complexes containing two or more Group VIII noble metals at concentrations that provide on average two metal dopant ions per grain. To achieve this, metal ion concentrations of $10^{-10}$ M are provided in solution, before blending with the emulsion to be doped. Typically useful metal dopant ion concentrations, based on silver, range from $10^{-10}$ to $10^{-3}$ gram atom per mole of silver. A specific concentration selection is dependent upon the specific photographic effect sought. For example, Dostes et al Defensive Publication T962,004 teaches metal ion dopant concentrations ranging from as low as $10^{-10}$ gram atom/Ag mole for reducing low intensity reciprocity failure and kink desensitization in negative-working emulsions; Spence et al U.S. Pat. Nos. 3,687,676 and 3,690,891 teach metal ion dopant concentrations ranging as high as $10^{-3}$ gram atom/Ag mole for avoidance of dye desensitization. While useful metal ion dopant concentrations can vary widely, depending upon the halide content of the grains, the metal ion dopant selected, its oxidation state, the specific ligands chosen, and the photographic effect sought, concentrations of less than $10^{-6}$ gram atom/Ag mole are contemplated for improving the performance of surface latent image forming emulsions without significant surface desensitization. Concentrations of from $10^{-9}$ to $10^{-6}$ gram atom/Ag mole have been widely suggested. Graphic arts emulsions seeking to employ metal dopants to increase contrast with incidental or even intentionally sought speed loss often range somewhat higher in metal dopant concentrations than other negative-working emulsions, with concentrations of up to $10^{-4}$ gram atom/Ag mole being common. For internal electron trapping, as is commonly sought in direct-positive emulsions, concentrations of greater than $10^{-6}$ gram atom/Ag mole are generally taught, with concentrations in the range of from $10^{-6}$ to $10^{-4}$ gram atom/Ag mole being commonly employed. For complexes that contain a single metal dopant ion molar and gram atom concentrations are identical; for complexes containing two metal dopant ions gram atom concentrations are twice molar concentrations; etc. Following the accepted practice of the art, stated dopant concentrations are nominal concentrations—that is, they are based on the dopant and silver added to the reaction vessel prior to and during emulsion precipitation.

The metal dopant ion coordination complexes can be introduced during emulsion precipitation employing procedures well known in the art. The coordination complexes can be present in the dispersing medium present in the reaction vessel before grain nucleation. More typically the coordination complexes are introduced at least in part during precipitation through one of the halide ion or silver ion jets or through a separate jet. Typical types of coordination complex introductions are disclosed by Janusonis et al, McDugle et al, Keevert et al, Marchetti et al and Evans et al, each cited above and here incorporated by reference. Another technique, demonstrated in the Examples below, for coordination complex incorporation is to precipitate Lippmann emulsion grains in the presence of the coordination complex followed by ripening the doped Lippmann emulsion grains onto host grains.

The emulsions prepared, apart from the metal ion dopant coordination complex, can take any convenient conventional form. Silver halide emulsions contemplated include silver bromide, silver iodobromide, silver chloride, silver chlorobromide, silver bromochloride, silver iodochloride, silver iodobromochloride and silver iodochlorobromide emulsions, where, in the mixed halides, the halide of higher concentration on a mole basis is named last. All of the above silver halides form a face centered cubic crystal lattice structure and are distinguishable on this basis from high (>90 mole %) iodide grains, that are rarely used for latent image formation. Conventional emulsion compositions and methods for their preparation are summarized in *Research Disclosure,* Item 308119, Section I, cited above and here incorporated by reference. Other conventional photographic features are disclosed in the following sections of Item 308119, here incorporated by reference:

II. Emulsion washing;
III. Chemical sensitization;
IV. Spectral sensitization and desensitization;
V. Brighteners;
VI. Antifoggants and stabilizers;
VII. Color materials;
VIII. Absorbing and scattering materials
IX. Vehicles and vehicle extenders
X. Hardeners
XI. Coating aids
XII. Plasticizers and lubricants
XIII. Antistatic layers
XIV. Methods of addition
XV. Coating and drying procedures
XVI. Matting agents
XVII. Supports
XVIII. Exposure
XIX. Processing
XX. Developing agents
XXI. Development modifiers
XXII. Physical development systems
XXIII. Image-transfer systems
XXIV. Dry development systems Although the invention has general applicability to the modification of photographic emulsions known to employ metal dopant ions for modification of photographic performance, specific applications have been observed that are particularly advantageous.

Rhodium hexahalides represent one well known and widely employed class of dopants employed to increase photographic contrast. Generally the dopants have been employed in concentration ranges of $10^{-6}$ to $10^{-4}$ gram atom of rhodium per mole of silver. Rhodium dopants have been employed in all silver halides exhibiting a face centered cubic crystal lattice structure. However, a particularly useful application for rhodium dopants is in graphic arts emulsions. Graphic arts emulsions typically contain at least 50 mole percent chloride based on silver and preferably contain more than 90 mole percent chloride.

One difficulty that has been encountered using rhodium hexahalide dopants is that they exhibit limited stability, requiring care in selecting the conditions under which they are employed. It has been discovered that the substitution of a C—C, H—C or C—N—H organic ligand for one or two of the halide ligands in rhodium hexahalide results in a more stable hexacoordination complex. Thus, it is specifically contemplated to substitute rhodium complexes of the type disclosed in this patent application for rhodium hexahalide complexes that have heretofore been employed in doping photographic emulsions.

In another specific application, it is recognized that spectral sensitizing dye, when adsorbed to the surface of a silver halide grain, allows the grain to absorb longer wavelength electromagnetic radiation. The longer wavelength photon is absorbed by the dye, which is in turn adsorbed to the grain surface. Energy is thereby transferred to the grain allowing it to form a latent image.

While spectral sensitizing dyes provide the silver halide grain with sensitivity to longer wavelength regions, it is quite commonly stated that the dyes also act as desensitizers. By comparing the native sensitivity of the silver halide grains with and without adsorbed spectral sensitizing dye it is possible to identify a reduction in native spectral region sensitivity attributable to the presence of adsorbed dye. From this observation as well as other, indirect observations it is commonly accepted that the spectral sensitizing dyes also are producing less than their full theoretical capability for sensitization outside the spectral region of native sensitivity.

It has been observed quite unexpectedly that increased spectral sensitivity of emulsions containing adsorbed spectral sensitizing dyes can be realized when the silver halide grains are doped with a group 8 metal dopant forming a tetracoordination or hexacoordination complex containing at least one C—C, H—C or C—N—H organic ligand and pseudohalide ligands containing Hammett sigma values more positive than 0.50.

The following pseudohalide meta Hammett sigma values are exemplary: CN 0.61, SCN 0.63 and SeCN 0.67. The meta Hammett sigma values for bromo, chloro and iodo ligands are in the range of from 0.35 to 0.39. The surprising effectiveness of the pseudohalide ligand containing complexes as compared to those that contain halide ligands is attributed to the greater electron withdrawing capacity of the pseudohalide ligands satisfying the stated Hammett sigma values. Further, the sensitizing effect has shown itself to be attainable with spectral sensitizing dyes generally accepted to have desensitizing properties either as the result of hole or electron trapping. On this basis it has been concluded that the dopants are useful in all latent image forming spectrally sensitized emulsions. The dopant can be located either uniformly or non-uniformly within the grains. For maximum effectiveness the dopants are preferably present within 500 Å of the grain surface, and are optimally separated from the grain surface by at least 50 Å. Preferred metal dopant ion concentrations are in the range of from $10^{-6}$ to $10^{-9}$ gram atom/Ag mole.

In another form it is contemplated to employ cobalt coordination complexes satisfying the requirements of the invention to reduce photographic speed with minimal (<5%) or no alteration in photographic contrast. One of the problems that is commonly encountered in preparing photographic emulsions to satisfy specific aim characteristics is that, in adjusting an emulsion that is objectionable solely on the basis of being slightly too high in speed for the specific application, not only speed but the overall shape of the characteristic curve is modified.

In has been discovered quite unexpectedly that cobalt tetracoordination and hexacoordination complexes satisfying the general requirements of the invention are capable of translating a characteristic curve along the log E (E=lux-second) exposure axis without significantly altering the shape of the characteristic curve. Specifically, contrast and minimum and maximum densities can all be maintained while decreasing sensitivity by doping. Preferred cobalt complexes are those that contain, in addition to one or two C—C, H—C or C—N—H organic ligands occupying up to two coordination sites, pseudohalide ligands that exhibit Hammett sigma values of that are more positive than 0.50. The cobalt complex can be uniformly or non-uniformly distributed within the grains. Cobalt concentrations are preferably in the range of from $10^{-6}$ to $10^{-9}$ gram atom/Ag mole.

In still another specific application of the invention it has been observed that group 8 metal coordination complexes satisfying the requirements of the invention that contain as the C—C, H—C or C—N—H organic ligand an aliphatic sulfoxide are capable of increasing the speed of high (>50 mole %) chloride emulsions and are capable of increasing the contrast of high (>50 mole %) bromide emulsions. Preferred aliphatic sulfoxides include those containing up to 12 (most preferably up to 6) nonmetal (e.g., carbon) atoms per aliphatic moiety. The coordination complex can occupy any convenient location within the grain structure and can be uniformly or non-uniformly distributed. Preferred concentrations of the group 8 metal are in the range of from $10^{-6}$ to $10^{-9}$ gram atom/Ag mole.

In still another specific application of the invention it has been observed that anionic $[IrX_xL_y]$ hexacoordination complexes, where X is Cl or Br, x is 4 or 5, L is C—C, H—C or C—N—H organic ligand, and y is 1 or 2, are surprisingly effective in reducing high intensity reciprocity failure (HIRF). As herein employed HIRF is a measure of the variance of photographic properties for equal exposures, but with exposure times ranging from $10^{-1}$ to $10^{-4}$ second. Improvements in HIRF are observed in doping all face centered cubic lattice structure silver halide grains, but the most striking improvements have been observed in high (>50 mole %) chloride emulsions. Preferred organic ligands are aromatic heterocycles of the type previously described. The most effective organic ligands are azoles, with optimum results having been achieved with thiazole ligands.

Also found to be unexpectedly useful in reducing HIRF are anionic $[IrX_5LMX'_5]$ hexacoordination complexes, where X and X' are independently Cl or Br, M is a group 8 metal, and L is a C—C, H—C or C—N—H organic bridging ligand, such as a substituted or unsubstituted aliphatic or aromatic diazahydrocarbon. Specifically preferred bridging organic ligands include $H_2N$-R-$NH_2$, where R is a substituted or unsubstituted aliphatic or aromatic hydrocarbon containing from 2 to 12 nonmetal atoms, as well as substituted or unsubstituted heterocycles containing two ring nitrogen atoms, such as pyrazine, 4,4'-bipyridine, 3,8-phenanthroline, 2,7-diazapyrene and 1,4-[bis(4-pyridyl)]butadiyne.

The iridate complexes identified above for use in reducing HIRF are useful in all photographic silver halide grains containing a face centered cubic crystal lattice structure. Exceptional performance has been observed in high chloride (>50 mole %) grain structures. The complex can be located either uniformly or non-uniformly within the grains. Concentrations preferably range from $10^{-6}$ to $10^{-9}$ gram atom Ir/Ag mole.

PREPARATIONS

Since the preparation of metal coordination complexes can be undertaken by the procedures described in the articles in which they are reported, cited above, preparations are provided for only those metal coordination complexes for which no source citation is listed.

Preparation of MC-52

$[IrCl_5(thiazole)]^{2-}$: 0.2 g of $K_2IrCl_5(H_2O)$ was reacted with 2 ml thiazole (Aldrich) in 20 ml $H_2O$ and stirred for 3 days. The solution was then evaporated to a small volume and precipitated by adding to 50 ml ethanol. The precipitate was filtered and washed with ethanol. The identity of this compound was confirmed by infrared (IR), ultraviolet and visible (UV/Vis) and nuclear magnetic resonance (NMR) spectroscopies and carbon, hydrogen and nitrogen (CHN) chemical analyses.

Preparation of MC-53

$[IrCl_5(pyz)Fe(CN)_5]^{5-}$: $Na_3K_2[IrCl_5(pyrazine)Fe(CN)_5]$ was prepared by reacting equimolar amounts of $K_2[IrCl_5(pyrazine)]$ and $Na_3[Fe(CN)_5(NH_3)].3H_2O$ in a small amount of $H_2O$ at room temperature for 24 hours. The volume was decreased with flowing nitrogen, and ethyl alcohol added to precipitate the final product. The product was assigned a formula of $Na_3K_2[IrCl_5(pyrazine)Fe(CN)_5]$ by IR, UV/VIS and NMR spectroscopies and by CHN chemical analyses.

Preparation of MC-54

$[IrCl_5(pyz)Ru(CN)_5]^{5-}$: The mixed metal dimer $K_5[IrCl_5(pyrazine)Ru(CN)_5]$ was prepared by reacting equimolar amounts of $K_3[Ru(CN)_5(pyrazine)]$ and $K_2[IrCl_5(H_2O)]$ in a small amount of $H_2O$ in a hot water bath at 80° C. for 2 hours. The volume was partially reduced with flowing nitrogen, and ethyl alcohol was added to precipitate the final product. The dimer was recrystallized by dissolving in a minimum amount of water and precipitated with ethyl alcohol. The product was assigned as $K_5[IrCl_5(pyrazine)Ru(CN)_5]$ by IR, UV/VIS, and NMR spectroscopies and by CHN chemical analyses.

Preparation of MC-56

$[Rh(CN)_5(thiazole)]^{2-}$: The synthesis of this compound was similar to literature methods described by G. L. Geoffroy, M. S. Wrighton, G. S. Hammond and H. B. Gray [Inorg. Chem. 13(2), 430–434, (1974)] with slight changes as described here. 0.5 g of $K_3[Rh(CN)_6]$ was dissolved in 100 ml $H_2O$ and adjusted to a pH of 2 with $HClO_4$. This solution was irradiated with a mercury lamp in a quartz tube for 24 hours. The solution was then evaporated down to 5 ml and chilled. The $KClO_4$ was filtered and 1 ml of thiazole in 1 ml of ethanol was added. This solution was again irradiated with the Hg lamp, this time for an hour. The volume was reduced, and ethanol was added to produce the final product. The precipitate which was formed was filtered and washed with ethanol. The identity of the compound was confirmed by IR, UV/Vis and NMR spectroscopies.

Preparation of MC-57

$[Rh_2Cl_{10}(pyz)]^{4-}$: $Na_4[Rh_2Cl_{10}(pyrazine)]$ was prepared by reacting $Na_3RhCl_6.12H_2O$ with pyrazine in a 2 to 1.05 (5% excess pyrazine) molar ratio at 100 C. in a minimum amount of $H_2O$ for 1 hour. Acetone was added to the cooled solution to give an oil and an orange colored liquid with some suspended solid material which was decanted. The oil was washed several times with acetone and decanted. The acetone was removed with a $N_2$ flow to give a sticky red substance which was then air dried in an oven at 100 C. for 1 hour to give a dark red material. This was recrystallized twice by dissolving in a minimum amount of $H_2O$ and precipitated with ethyl alcohol. The final material was filtered, washed with ethyl alcohol, and air dried. The product was assigned as $Na_4[Rh_2Cl_{10}(pyrazine)]$ by IR, UV/Vis and NMR spectroscopies and by CHN chemical analyses.

Preparation of MC-55

$[Ru(CN)_5(pyz)Fe(CN)_5]^{6-}$: $Na_3K_3[Ru(CN)_5(pyrazine)Fe(CN)_5]$ was similarly prepared by stirring equimolar amounts of $K_3[Ru(CN)_5(pyrazine)]$ and $Na_3[Fe(CN)_5(NH_3)].3H_2O$ in a small amount of $H_2O$ at room temperature for 24 hours. The volume was decreased with flowing nitrogen, and ethyl alcohol added to precipitate the final product. The product was assigned as $Na_3K_3[Ru(CN)_5(pyrazine)Fe(CN)_5]$ by IR, UV/VIS and NMR spectroscopies and by CHN chemical analyses.

Preparation of MC-58

$[RhCl_3(oxazole)_3]$: 0.5 g of $(NH_4)_2[RhCl_5(H_2O)]$ was reacted with 0.5 ml oxazole in 15 ml $H_2O$ for 3 days. The solution was then added to a large amount of acetone whereupon a white precipitate appeared. The precipitate ($NH_4Cl$) was filtered off. A yellow solid was obtained after evaporating the solvent from the flitrate. This yellow solid was washed with cold acetone in which it was slightly soluble. Slow evaporation of the acetone solution provided bright yellow crystals. The yellow product was assigned as $RhCl_3(oxazole)_3$ by Infrared, UV/Vis, and NMR spectroscopies and CHN chemical analysis.

Preparation of MC-59

$[Fe(CN)_5TQ]^{3-}$: The synthesis of this compound is similar to reported methods of various $Na_xFe(CN)_5L$ compounds [H. E. Toma and J. M. Malin, Inorg. Chem. 12(5), 1039–1045, (1973)]. 0.5 g of $Na_3[Fe(CN)_5(NH_3)].3H_2O$ was dissolved in 5 ml $H_2O$ and added to 0.26 g of s-triazolo [4,3-a] quinoline in 5 ml ethanol. The solution was mixed for 1 week then evaporated to 2 ml and precipitated by adding to ethanol. This provided an oil and a light brown precipitate. The precipitate was filtered and the solution was decanted from the oil. The oil was dissolved in a small amount of water and added to a large excess of ethanol. This afforded more brown precipitate. The precipitates were washed with ethanol and analyzed using IR, UV/Vis and NMR spectroscopies and CHN chemical analysis.

EXAMPLES

The invention can be better appreciated by reference to the following specific examples:

Comparative Dopants

Except for comparative dopant complexes CD-7 and CD-8, the comparative dopant (CD) complexes listed in Table I below were purchased from commercial sources. CD-7 and CD-8 were prepared as reported by M. Delephine, *Ann. Chim.*, 19, 145 (1923). EDTA=ethylenediaminetetraacetic acid

TABLE I

| | |
|---|---|
| CD-1 | EDTA |
| CD-2 | $[Fe(EDTA)]^{-1}$ |
| CD-3 | $[IrCl_6]^{-2}$ |
| CD-4 | $K_2C_2O_4.H_2O$ |
| CD-5 | $[Fe(CN)_6]^{-4}$ |
| CD-6 | $[Fe(C_2O_4)_3]^{-3}$ |
| CD-7 | $[cis\text{-}IrCl_2(C_2O_4)_2]^{-3}$ |
| CD-8 | $[Ir(C_2O_4)_3]^{-3}$ |

Example 1

The purpose of this example is to demonstrate the incorporation of C—C, H—C or C—N—H organic ligands within a silver halide grain structure.

An emulsion F19 was prepared as described below in the F Series Examples, doped with 43.7 molar parts per million (mppm) of dopant MC-14c.

Electron paramagnetic resonance spectroscopic measurements were made on emulsion F19 at temperatures between 5° and 300° K., using a standard X-band homodyne EPR spectrometer and standard cryogenic and auxiliary equipment, such as that described in Electron Spin Resonance, 2nd Ed., *A Comprehensive Treatise on Experimental Techniques,* C. P. Poole, Jr., John Wiley & Sons, New York, 1983. These measurements provided detailed structural information about the microscopic environment of the dopant ion, and, in this example, showed that all or most of the iron added during precipitation was incorporated in the silver chloride grain crystal structure in the Fe(II) valence state, and all of the incorporated Fe(II) ions had their ligands intact so that $[Fe(CN)_5bipyridyl)]^{3-}$ replaced a $[AgCl_6]^{5-}$ moiety.

No EPR signals were observed from the doped sample unless it was exposed to light or strong oxidants, such as gaseous chlorine. After exposure to band-to-band light excitation (365 nm) between 260° K. and room temperature, EPR signals were observed at 5°–8° K. These signals were not observed from the undoped control sample after light exposure. Discernible in these signals were powder pattern lineshapes like those typically observed from a randomly oriented ensemble of low symmetry paramagnetic species in a powder or frozen solution. The strongest powder patterns had $g_1$ features at 2.924 (Site I), 2.884 (Site II) and 2.810 (Site III), each with a linewidth at half maximum of 1.0±0.1 mT, shown below to be from four distinct kinds of $[Fe(CN)_5(bipyridyl)]^{2-}$ complexes in which the metal ions have low spin $d^5$ electronic configurations.

By analogy to previous studies of substitutional low spin $d^5$ transition metal complexes in the silver halides and structurally related crystals, such as described in D. A. Corrigan, R. S. Eachus, R. E. Graves and M. T. Olm, *J. Chem. Phys.* 70, 5676 (1979) for $(RuCl_6)^{3-}$ centers in AgCl and $(RuBr)_6^{3-}$ centers in AgBr, and R. S. Eachus and M. T. Olm, *Rad. Eff.* 73, 69 (1983) for $(OsCl_6)^{3-}$ in AgCl and $(OsBr_6)^{3-}$ centers in AgBr, these $[Fe(CN)_5(bipyridyl)]^{2-}$ complexes differ in the arrangement of the associated silver ion vacancies which are necessary to provide charge neutrality in the silver chloride lattice. The $g_2$ feature corresponding to the major structural center (Site I) was at 2.286. The other three $g_2$ signals were at 2.263 (Site II), 2.213 (Site III) and 2.093 (Site IV). The value of $g_3$ for the major $[Fe(CN)_5(bipyridyl)]^{2-}$ complex in AgCl (Site I) was found to be 1.376. The $g_3$ features from the three secondary bipyridyl complexes were not resolved in our experiments. The g values determined for the $[Fe(CN)_5(bipyridyl)]^{2-}$ complex with silver ion vacancies present in the highest concentration (Site I) are consistent with the assignment to a rhombic, low spin Fe(III) complex substituting for $(AgCl_6)^{5-}$ in the cubic silver chloride lattice.

The powder pattern EPR spectrum was also observed after the doped, unexposed silver chloride emulsion was placed in an oxidizing atmosphere of chlorine gas. The observations that this pattern was absent before exposure and was produced by the oxidizing atmosphere confirmed that the $[Fe(CN)_5(bipyridyl)]$ complex dopant was incorporated with the metal ion in the Fe(II) state, which is invisible to EPR measurements, and that the Fe(II) ion trapped a hole (was oxidized) to produce the Fe(III) oxidation state during exposure to chlorine or light.

It was established that the dopant was incorporated primarily as $[Fe(CN)_5(bipyridyl)]^{3-}$ with the ligands surrounding the ferrous ion intact by comparing the observed EPR spectra with those obtained upon doping silver chloride powders with the most chemically-feasible, ligand-exchanged contaminants of the dopant salt that might be produced during synthesis of the dopant or precipitation of the emulsion. The species $[Fe(CN)_6]^{4-}$, $[Fe(CN)_5(H_2O)]^{3-}$ $[Fe(CN)_5Cl]^{4-}$ and $[Fe_2(CN)_{10}]^{6-}$ were investigated. The EPR spectra of the corresponding Fe(III) species produced in the silver chloride grains by band-to-band excitation or exposure to chlorine were quite distinct from those assigned to the four $[Fe(CN)_5(bipyridyl)]^{2-}$ dopant complexes.

From the foregoing it was concluded that the bipyridyl ligand was sufficiently stable in aqueous solution to minimize its exchange with chloride or water during coprecipitation. Considering the observation of a well-resolved EPR powder pattern from the doped emulsion, the high yields of the low spin Fe(III) photoproducts, and the propensity of low spin Fe(III) ions for six-fold coordination, it is clear that $[Fe(CN)_5(bipyridyl)]^{3-}$ is incorporated substitutionally in silver chloride, replacing a $[AgCl_6]^{5-}$ moiety. Despite the presence off the bulky organic ligand, it is not occluded as a separate phase or adsorbed as a surface species.

A SERIES EXAMPLES

These examples have as their purpose to demonstrate reduced dye desensitization and reduced high intensity reciprocity failure (HIRF) in octahedral (i.e., regular {111}) silver bromide emulsions as a result of introducing during precipitation metal coordination complexes satisfying the requirements of the invention. These examples demonstrate favorable comparisons to emulsions prepared in the absence of metal coordination complexes and to emulsions prepared in the presence of iron hexacyanide (CD-5).

Five solutions were prepared as follows:

| | |
|---|---|
| Solution A: | |
| Gelatin (bone) | 40 g |
| D. W. | 1500 g |
| Solution B: | |
| 2.5N Sodium bromide | |
| Solution C | |
| 2.5N Silver nitrate | |
| Solution D | |
| Gelatin (phthalated) | 50 g |
| D. W. | 300 g |
| Solution E | |
| Gelatin (bone) | 119 g |
| D. W. | 1000 g |

Emulsion A1 was prepared as follows: solution A was adjusted to a pH of 3 at 40° C. with 2N $HNO_3$ and the temperature was adjusted to 70° C. The pAg of solution A was adjusted to 8.19 with solution B. Solutions B and C were run into solution A with stirring at a constant rate of 1.25 ml/min for four minutes. The addition rate was accelerated to 40 ml/min over the next 40 minutes. The resulting mixture was cooled to 40° C. Solution D was then added with stirring and the mixture was held for 5 minutes. The pH was then adjusted to 3.35 and the gel was allowed to settle. The temperature was dropped to 15° C. for 15 minutes and the liquid layer was decanted. The depleted liquid volume was then restored with distilled water and the pH was readjusted to 4.5. The mixture was redispersed with stirring at 40° C. and the pH was adjusted to 5. The pH was then readjusted to 3.75 and once again the gel was allowed to settle, the mixture was cooled and the liquid layer decanted. The temperature was readjusted to 40° C. and solution E was added. The final pH and pAg were approximately 5.6 and 8.06 respectively. Control emulsions prepared in this fashion had a narrow distributions of sizes and morphologies; emulsion grains were octahedral in shape with edge lengths of 0.5 μm±0.05 μm.

Doped emulsion A1a was prepared as described for emulsion A1 except that during the accelerated portion of the reagent addition, after 603 cc of solution B had been added, a dopant solution was substituted for solution B. After the dopant solution was depleted, it was replaced by solution B.

| Dopant Anion | Dopant Solution for Emulsion A1a | |
|---|---|---|
| CD-5 | $K_4Fe(CN)_6$ | 12.04 mg |
| | Solution B | 181 cc |

Doped emulsions prepared in this fashion were monodispersed in size and shape and had octahedral edge lengths of 0.5 microns±0.05 microns. The resulting doped emulsion A1a nominally contained a total of 11 molar parts per million (mppm) of dopant in the outer 72% to 93.5% of the grain volume; i.e., the emulsion had an undoped shell of approximate thickness 40 to 100 Å.

Doped emulsion A1b was prepared as described for emulsion A1, except that the dopant solution was modified to introduce a total of 55 molar parts per million (mppm) of (comparison dopant CD-5) in the outer 72% to 93.5% of the grain volume.

Doped emulsion A2 was prepared as described for emulsion A1, except that the dopant solution was modified to introduce a total of 5.2 molar parts per million (mppm) of dopant MC-14b and 2.6 mppm of MC-48 in the outer 72% to 93.5% of the grain volume. The initial 0 to 72% of the grain volume and the final 93.5% to 100% of the grain volume were undoped.

Doped emulsion A3 was prepared as described for emulsion A2, except that the dopant solution was modified to introduce 11 mppm of dopant MC-48 into the outer 72% to 93.5% of the grain volume.

Doped emulsion A4 was prepared as described for emulsion A2, except that the dopant solution was modified to introduce 2.6 mppm of dopant MC-14c and 3.9 mppm of dopant MC-49 into the outer 72% to 93.5% of the grain volume.

Doped emulsion A5 was prepared as described for emulsion A2, except that the dopant solution was modified to introduce 12.9 mppm of dopant MC-14c and 19.4 mppm of dopant MC-49 into the outer 72% to 93.5% of the grain volume.

Doped emulsion A6 was prepared as described for emulsion A2, except that the dopant solution was modified to introduce 6.6 mppm of dopant MC-49 into the outer 72% to 93.5% of the grain volume.

Doped emulsion A7 was prepared as described for emulsion A2, except that the dopant solution was modified to introduce 28.9 mppm of dopant MC-49 into the outer 0.5% to 93.5% of the grain volume. Analysis of this emulsion by inductively coupled plasma atomic emission spectropscopy (ICP-AES) showed that the Fe level was, within experimental error, the same as in emulsions prepared like A7 but doped with the conventional dopant anion $(Fe(CN)_6)^{4-}$ (60.7%±4.6% vs 73.6%±9.8%).

Doped emulsion A8 was prepared as described for emulsion A2, except that the dopant was modified to introduce 5.6 mppm of dopant MC-59 into the outer 72% to 93.5% of the grain volume.

Doped emulsion A9 was prepared as described for emulsion A2, except that the dopant solution was modified to introduce 10.B mppm of dopant MC-15a into the outer 72% to 93.5% of the grain volume.

Doped emulsion A10 was prepared as described for emulsion A2, except that the dopant was dissolved in 181 cc of water, and this was added to the emulsion through a third jet so as to introduce 6.6 mppm of dopant MC-49 into the outer 72% to 93.5% of the grain volume.

Doped emulsion A11 was prepared as described for emulsion A2, except that the dopant solution was modified to introduce 55.3 mppm of dopant MC-141 into the outer 50% to 93.5% of the grain volume.

Doped emulsion A12 was prepared as described for emulsion A2, except that the dopant solution was modified to introduce 26 mppm of dopant MC-50 into the outer 72% to 93.5% of the grain volume.

Doped emulsion A13 was prepared as described for emulsion A2, except that the dopant solution was modified to introduce 55 mppm of dopant MC-14n into the outer 72% to 93.5% of the grain volume.

Doped emulsion A14 was prepared as described for emulsion A2, except that the dopant solution was modified to introduce 11 mppm of dopant $[Fe(EDTA)]^{-1}$ (CD-2) into the outer 72% to 93.5% of the grain volume.

Doped emulsion A15 was prepared as described for emulsion A2, except that the dopant solution was modified to introduce 55.3 mppm of dopant $[Fe(C_2O_4)_3]^{3-}$ (CD-6) into the outer 50% to 93.5% of the grain volume.

Doped emulsion A16 was prepared as described for emulsion A2, except that the dopant solution was modified to introduce 55 mppm of dopant MC-15a into the outer 50% to 93.5% of the grain volume. Ion coupled plasma mass spectrometry (ICP-MS) analysis showed that Ru incorporation was at least as high as that measured in an identical emulsion doped with the comparative dopant anion $[Ru(CN)_6]^{4-}$.

PHOTOGRAPHIC COMPARISONS

Portions of emulsions A1, A1a, A1b, A4, A5 and A6 were sensitized by the addition of 28 micromole/mole Ag of sodium thiosulfate and 22 micromole/mole Ag of his (1,4,5-triethyl-1,2,4-triazolium-3-thiolate gold(I) tetrafluroborate, followed by a digestion for 40 minutes at 70° C. The chemically sensitized emulsions were divided into 3 portions. The red spectral sensitizing dye (DYE A) (5,5'-dichloro-3,3',9-triethylthiacarbocyanine p-toluenesulfonate) was added from methanolic solution at levels of 0.50 and 0.75 millimole per Ag mole to two of the portions after which the samples were held at 40° C. for one hour.

Coatings of each of emulsion were made at 21.5 mg Ag/dm$^2$ and 54 mg gelatin/dm$^2$ with a gelatin overcoat layer containing 10.8 mg gelatin/dm$^2$ a surfactant and a hardener, on a cellulose acetate support. Some coatings of each sensitized emulsion were exposed for 0.1 second to 365 nm on a standard sensitometer and then developed for 6 minutes in Kodak Rapid X-Ray TM developer, a hydroquinone-Elon TM (N-methyl-p-aminophenol hemisuifate) surface developer at 21° C. Other coatings were evaluated for reciprocity response by giving them a series of calibrated (total energy) exposures ranging from 1/10,000th of a second to 1 second, These were also developed for 6 minutes at 21° C. in a hydroquinone-Elon TM surface developer.

The photographic response of emulsions A, A1a, A1b, A4, A5 and A6 are shown in Tables A-I to A-III.

TABLE A-I

| Metal ion | Δ Dmin 0.50 | Δ speed 0.50 | Δ Dmin 0.75 | Δ speed 0.75 |
|---|---|---|---|---|

TABLE A-I-continued

| Emul. | Dopant | conc. (PPM) | dye level | dye level | dye level | dye level |
|---|---|---|---|---|---|---|
| A1 | none | none | 0 | 0 | 0 | 0 |
| A1a | CD-5 | 11 | 2 | 14 | 4 | 18 |
| A1b | CD-5 | 55 | 16 | 51 | 17 | 60 |

TABLE A-II

| Emul. | Dopant | Metal ion conc. (PPM) | Δ Dmin 0.50 dye level | Δ speed 0.50 dye level | Δ Dmin 0.75 dye level | Δ speed 0.75 dye level |
|---|---|---|---|---|---|---|
| A1 | none | none | 0 | 0 | 0 | 0 |
| A1a | CD-5 | 11 | 2 | 14 | 4 | 18 |
| A4 | MC-49, MC-14c | 10.5 | −2 | 30 | 1 | 47 |
| A6 | M-49 | 13.2 | 9 | 49 | 5 | 82 |

TABLE A-III

| Emul. | Dopant | Metal ion conc. (PPM) | Δ Dmin 0.50 dye level | Δ speed 0.50 dye level | Δ Dmin 0.75 dye level | Δ speed 0.75 dye level |
|---|---|---|---|---|---|---|
| A1 | none | none | 0 | 0 | 0 | 0 |
| A1b | CD-5 | 55 | 16 | 51 | 17 | 60 |
| A5 | MC-49 | 51.7 | −4 | 42 | −2 | 72 |

Δ Dmin is the difference in minimum optical density between the undoped control and the doped emulsion, × 100. Smaller values indicate, less increase in Dmin attributable to doping.

Δ speed is the difference in speed (measured at 0.15 optical density) between the undoped control and the doped emulsion, × 100. Larger values indicate larger speed increases attributable to doping.

Results for two dye levels, corresponding to about 60 and 90% dye coverage of the available grain surface area, are shown in Tables AI-III. It is desirable to increase dye level as much as possible in order to increase the amount of light absorbed by the emulsions and thereby increase sensitivity. Unfortunately, for many commonly used dyes, as the dye level is increased, a maximum in sensitivity is reached at dye levels corresponding to much less than 100% coverage of the grain surface. Increasing the dye level beyond this maximum either gives no additional speed or causes a speed loss. At these higher dye levels, the dye itself is a cause of desensitization. It is known that emulsions doped with a preferred class of hexacoordination complexes of transition metals, capable of forming sensitivity enhancing shallow electron trapping sites, show an increased resistance to dye desensitization as evidenced by improved speed of the dyed, doped emulsions compared to dyed, undoped emulsions (see Bell, Reed, Olm U.S. Pat. No. 5,132,203). One problem encountered with these doped emulsions is that, as more dopant is added to increase resistance to dye desensitization, the level of Dmin increases. This is demonstrated by the results from the comparative examples in Table A-I.

Table A-II shows that emulsions doped with the invention compounds, MC-14c (discussed in the example above) and MC-49, show improved resistance to dye desensitization, and also show either improved resistance to dye desensitization or lower Dmin or both when compared to the comparison emulsion A1a.

Table A-III demonstrates that an emulsion doped with the invention compound MC-49 does not exhibit increased Dmin at high dopant levels, unlike the emulsion doped with (CD-5).

A portion of each of the emulsions described above was optimally chemically sensitized by the addition of sodium thiosulfate and bis (1,4,5-triethyl-1,2,4-triazolium-3-thiolate gold(I) tetrafluroborate, followed by a digestion for 40 minutes at 70° C. The chemically sensitized emulsions were divided into 4 portions. The red spectral sensitizing dye (DYE A) (5,5'-dichloro-3,3',9-triethylthiacarbocyanine p-toluenesulfonate) was added from methanolic solution at levels of 0.25, 0.50 and 0.75 millimole per Ag mole to three of the portions after which the samples were held at 40° C. for one hour.

Doped Emulsion A6 and control Emulsion A1 were also chemically and spectrally sensitized as described above, except that the green spectral sensitizer 5,6,5',6'-dibenzo-1,1'-diethyl-2,2'-tricarbocyanine iodide (Dye B) was used in place of Dye A at levels of 0.0375 and 0.075 mole/mole of silver.

These emulsions were coated, exposed and evaluated as described above. The results are given in Tables A-IV to A-VII.

TABLE A-IV

Diff. in Log Relative Speed times 100, between Doped, Dyed (Dye A) Emulsions and Undoped, Dyed Control[a]

| Emulsion | Dopant | 0.25 mmole dye/Ag mole | 0.50 mmole dye/Ag mole | 0.75 mmole dye/Ag mole |
|---|---|---|---|---|
| A1 | none | 0 | 0 | 0 |
| A2 | MC-14b, MC-48 | 6 | 32 | 62 |
| A3 | MC-48 | 39 | 43 | 60 |
| A4 | MC-14c MC-49 | 20 | 12 | 44 |
| A5 | MC-14c MC-49 | 14 | 27 | 122 |
| A6 | MC-49 | 16 | | 79 |
| A7 | MC-49 | 6 | 9 | 26 |
| A8 | MC-59 | 30 | 56 | 82 |
| A9 | MC-15a | 20 | 33 | 58 |
| A10 | MC-49 | 32 | 111 | 92 |
| A11 | MC-141 | −5 | 57 | 10 |
| A12 | MC-50 | 22 | 107 | 68 |
| A13 | MC-14n | 25 | 109 | 61 |

[a]The larger the speed number the greater the improvement in dyed speed in the doped emulsion over the undoped control. Speed measured at 0.15 optical density above Dmin.

TABLE A-V

Difference between Relative Log Speeds times 100, obtained at 0.01 and $10^{-5}$ sec exposure, measured at $D_{min}$ plus 0.15 density. (Dye A)*

| Emulsion | Dopant | 0.25 mmole dye/Ag mole | 0.50 mmole dye/Ag mole | 0.75 mmole dye/Ag mole |
|---|---|---|---|---|
| A1 | none | 20 | 24 | 16 |
| A2 | MC-14b, MC-48 | 12 | 6 | −7 |
| A5 | MC-14c, MC-49 | 4 | 3 | 3 |
| A6 | MC-49 | 15 | 13 | 1 |

*Smaller values indicate less HIRF.

TABLE A-VI

Difference in Log Relative Speed times 100, between Doped, Dyed Emulsions (Dye B) and Undoped, Dyed Control, Comparative Examples.

| Emulsion | Dopant | 0.0375 mmole dye/Ag mole | 0.075 mmole dye/Ag mole |
|---|---|---|---|
| A1 | None | 0 | 0 |
| A6 | MC-49 | 49 | 55 |

The speed increases of the dyed doped invention emulsions relative to the dyed undoped control are shown in Table A-IV and Table A-VI. As the level of Dye A or Dye B was increased in the sensitized control emulsion, the overall speed of the emulsion decreased. The dyed doped invention emulsions showed higher speed than the dyed undoped control emulsion in all cases. Similarly, as can be seen from Table A-V, high intensity reciprocity failure was improved in the doped invention emulsions compared to the undoped control emulsion.

TABLE A-VII

DIFFERENCE IN LOG RELATIVE SPEED TIMES 100, BETWEEN DOPED, DYED EMULSIONS (DYE A) AND UNDOPED, DYED CONTROL, COMPARATIVE EXAMPLES.*

| EMUL. | DOPANT | 0.00 MMOLE DYE/AG MOLE | 0.25 MMOLE DYE/AG MOLE | 0.50 MMOLE DYE/AG MOLE | 0.75 MMOLE DYE/AG MOLE |
|---|---|---|---|---|---|
| A1 | NONE | 0 | 0 | 0 | 0 |
| A14 | (CD-2) | 0 | 6 | −53 | −35 |
| A15 | (CD-6) | 3 | −5 | −55 | −31 |

*The larger the speed number, the greater the improvement in dyed speed in the doped emulsion over the undoped control. Speed measured at 0.15 optical density above Dmin.

Comparative Emulsions A14 and A15 were doped with dopant anions $[Fe(EDTA)]^{-1}$ (CD-2) and $[Fe(C_2O_4)_3]^{3-}$ (CD-6), respectively. Dopant anions (CD-2) and (CD-6) do not satisfy the requirements of this invention. ICP-AES measurements of the Fe content in degelled emulsion A14 showed no significant increase in Fe level above background levels despite the addition of the iron-containing comparative dopant $[Fe(EDTA)]^{-1}$ (CD-2). This failure to incorporate Fe was reflected by the failure to see a significant change in undyed speed as a result of doping with (CD-2) and the observation of significantly reduced dyed speeds in the doped emulsion A14. The latter change is attributed to the presence of unincorporated dopant on the grain surface. The observation of similar effects in emulsion A15 indicate that no part of dopant $[Fe(C_2O_4)_3]^{3-}$ (CD-6) was effectively incorporated into the silver bromide grain.

B SERIES EXAMPLES

These examples have as their purpose to demonstrate reduced dye desensitization and reduced high intensity reciprocity failure (HIRF) in octahedral (i.e., regular {111}) silver bromoiodide emulsions as a result of introducing during precipitation metal coordination complexes satisfying the requirements of the invention.

Emulsion B1 The double jet precipitation method described in Example A was modified to produce $AgBr_{0.97}I_{0.03}$ octahedral emulsions with edge lengths of 0.5 μm±0.05 μm and with the iodide distributed uniformly throughout the emulsion grain.

Emulsion B2 was precipitated like Emulsion B1, except that 13.4 mppm total of dopant anion MC-49 was introduced into the outer 72 to 93.5% of the grain volume. The initial 0 to 72% of the grain volume and the final 93.5% to 100% of the grain volume was undoped.

A portion of each of these emulsions was optimally chemically sensitized by the addition of 100 mg/Ag mole of sodium thiocyanate, 16 μmole/Ag mole of sodium thiosulfate and bis (1,4,5-triethyl-1,2,4-triazolium-3-thiolate gold(I) tetrafluroborate at 40° C., followed by a digestion for 22 minutes at 70° C. The chemically sensitized emulsions were divided into 3 portions. The red spectral sensitizing dye (DYE A) (5,5'-dichloro-3,3',9-triethylthiacarbocyanine p-toluenesulfonate) was added, from methanolic solution at levels of 0.50 and 0.75 millimoles per Ag mole to two of the portions after which the samples were held at 40° C. for one hour.

PHOTOGRAPHIC COMPARISON

Emulsions B were coated and exposed as described for Emulsions A.

TABLE B-I

Difference in Log Relative Speed times 100, between Doped, Dyed Emulsion and Undoped, Dyed Control*

| Emulsion | Dopant | 0.50 mmole dye/Ag mole | 0.75 mmole dye/Ag mole |
|---|---|---|---|
| B1 | none | 0 | 0 |
| B2 | MC-49 | 36 | 43 |

*The larger the speed number the greater the improvement in dyed speed in the doped emulsion over the undoped control.

TABLE B-II

Difference between relative log speeds times 100, obtained at 0.01 and $10^{-5}$ sec exposure, measured at $D_{min}$ plus 0.15 density.*

| Emulsion | Dopant | 0.50 mmole dye/Ag mole | 0.75 mmole dye/Ag mole |
|---|---|---|---|
| B1 | none | 25 | 41 |
| B2 | MC-49 | 9 | 11 |

*Results are improved as differences diminish.

As the level of Dye A was increased in the sensitized control emulsion, the overall speed of the emulsion decreased. The dyed doped emulsion showed higher speed than the dyed undoped control emulsion in all cases. The speed increases of the dyed doped emulsion relative to the dyed undoped control are shown in Table B-I. Similarly, as can be seen from Table B-II, high intensity reciprocity failure generally increased with the addition of dye in control emulsions. High intensity reciprocity failure was improved in the doped emulsions.

C SERIES EXAMPLES

These examples demonstrate the effectiveness of cobalt coordination complexes with organic ligands to reduce photographic speed while otherwise retaining emulsion characteristics—e.g., $D_{min}$ and contrast.

Emulsion C1 The double jet precipitation method used for Emulsion A7 was used to produce the monodispersed, 0.5 μm edge length, octahedral AgBr grains, except that the dopant solution was modified to introduce a total of 11 mppm of dopant anion MC-19 into the outer 72–92.5% of the grain volume.

This emulsion was chemically sensitized by the addition of sodium thiosulfate and bis (1,4,5-triethyl-1,2,4-triazolium-3-thiolate gold(I) tetrafluroborate, followed by a digestion for 40 minutes at 70° C. The levels of these sensitizers necessary to give optimum speed and minimum density were determined for emulsions C1 and A1 and these were used for the coatings described below.

PHOTOGRAPHIC COMPARISON

Emulsion C1 was coated and exposed as described for Emulsions A.

The photographic parameters of emulsion C1 are compared to those of a control emulsion A1 in Table C-I. It can be seen that this level and placement of dopant MC-19 is useful for decreasing the speed of the emulsion without modifying curve shape.

| Emulsion | Dopant | $D_{min}$ | Speed | Contrast |
|---|---|---|---|---|
| A1 | none | 0.10 | 306 | 1.58 |
| C1 | MC-19 | 0.10 | 237 | 1.57 |

D SERIES EXAMPLES

These examples have as their purpose to demonstrate the effectiveness of coordination complexes with aliphatic sulfoxide ligands to increase the contrast of silver bromide emulsions.

Emulsion D1: The double jet precipitation method used for Emulsion A2 was used to produce the monodispersed, 0.5 μm edge length, octahedral AgBr grains, except that the dopant solution was modified to introduce a total of 46.7 mppm of dopant anion MC-14rr into the outer 0.5 to 93.5% of grain volume. This emulsion was optimally sulfur and gold chemically sensitized employing a digestion for 40 minutes at 70° C.

Emulsion D2 was prepared like emulsion D1, except that the dopant solution was modified to introduce a total of 100 mppm of dopant anion MC-14rr into the outer 72% to 93.5% of the grain volume. This emulsion was optimally sulfur and gold chemically sensitized employing a digestion for 40 minutes at 70° C.

The criterion for optimum chemical sensitization was maximum speed and higher contrast with low minimum density. The same chemical sensitization was given to a sample of control emulsion A1 and these emulsions were used for the coatings described below.

PHOTOGRAPHIC COMPARISON

Emulsions D1 and D2 were coated and exposed as described for the A Series Emulsions.

The photographic parameters of emulsions D1 and D2 are compared to those of a control emulsion A1 in Table D-I. It can be seen that dopant MC-14rr was useful for increasing the contrast of the doped emulsions compared to the undoped control.

TABLE D-I

Dmin, Log Relative Speed times 100 and Contrast for Emulsions A1, D1 and D2

| Emulsion | Dopant | $D_{min}$ | Speed | Contrast |
|---|---|---|---|---|
| A1 | none | 0.10 | 271 | 1.94 |
| D1 | MC-14rr | 0.10 | 235 | 2.25 |
| D2 | MC-14rr | 0.10 | 213 | 2.61 |

E SERIES EXAMPLES

These examples have as their purpose to demonstrate the effectiveness of coordination complexes of rhodium and at least one organic ligand to increase the contrast of regular cubic grain silver bromochloride emulsions.

Emulsion E1 was prepared as follows:

| | |
|---|---|
| Solution A: | |
| Gelatin (bone) | 180 g |
| D. W. | 7200 g |
| Solution B: | |
| 1.2N in Sodium bromide | |
| 2.8N in Sodium chloride | |

-continued

| | |
|---|---|
| Solution C | |
| 2.0N Silver nitrate | |
| Solution D | |
| Gelatin (bone) | 180 g |
| D. W. | 1000 g |

Solution A was adjusted to a pH of 3 at 35° C., and pAg was adjusted to 7.87 with a NaCl solution. Solutions B and C were run into solution A with stirring. Solutions B and C were run in at rates of about 17.3 and 30 ml/min, respectively, for the first 3 minutes. The addition rate of solution C was then ramped from 30 to 155 ml/min and solution B was ramped from 17.3 to 89.3 ml/min in 12.5 min. Solutions C and B were then run in at 155 ml/min and 89.3 ml/min respectively for 21 min. The pAg was controlled at 7.87 during the addition of solutions B and C. The temperature was then raised to 40° C. and the pAg adjusted to 8.06. The emulsion was washed until the pAg measured 7.20. The emulsion was concentrated and solution D was added. The pAg was adjusted to 7.60 and the pH adjusted to 5.5.

The $AgCl_{0.70}Br_{0.30}$ emulsions prepared had a narrow distribution of grain sizes and morphologies; emulsion grains were cubic shape with edge lengths of 0.17 μm.

Emulsion E1 was chemically sensitized by the addition of 0.812 mg/Ag mole of 4,4'-phenyl-disulfide diacetanilide from methanolic solution, $13.35\times10^{-6}$ mole/Ag mole of 1,3-di(carboxymethyl)-1,3-dimethyl-2-thiourea disodium monohydrate and $8.9\times10^{-6}$ mole/Ag mole potassium tetrachloroaurate(III), followed by a digestion for 10 minutes; at 65° C.

Emulsion E2 was prepared and sensitized as for emulsion E1, except that the salt solution was modified so as to introduce a total of 0.14 mppm of dopant anion MC-57 through the entire emulsion grain.

PHOTOGRAPHIC COMPARISON

Coatings of each of the above optimally sensitized emulsions were made at 21.5 mg Ag/dm$^2$ and 54 mg gelatin/dm$^2$ with a gelatin overcoat layer made at 10.8 mg gelatin/dm$^2$ a surfactant and a hardener, on a cellulose acetate support. Some coatings of each sensitized emulsion were exposed for 0.1 second to 365 nm on a standard sensitometer and then developed for 6 minutes in a hydroguinone-Elon TM (N-methyl-p-aminophenol hemisulfate) surface developer at 21° C.

The photographic parameters of emulsions E1 and E2 are shown in Table E-I. It can be seen that dopant MC-57 was useful for increasing emulsion contrast and for reducing Dmin.

TABLE E-I

Dmin, Log Relative Speed times 100 and Contrast for Emulsions E

| Emulsion | Dopant | $D_{min}$ | Speed | Contrast |
|---|---|---|---|---|
| E1 | none | 0.04 | 235 | 3 |
| E2 | MC-57 | 0.03 | 171 | 3.6 |

F SERIES EXAMPLES

These examples have as their purpose to demonstrate the effectiveness of coordination complexes of iridium and/or iron and at least one organic ligand to increase speed and reduce reciprocity failure of regular cubic grain silver chloride emulsions.

Control Emulsion F1 was prepared in the absence of any dopant salt. A reaction vessel containing 5.7 liters of a 3.95% by weight gelatin solution was adjusted to 46° C., pH of 5.8 and a pAg of 7.51 by addition of a NaCl solution. A solution of 1.2 grams of 1,8-dihydroxy-3,6-dithiaoctane in 50 ml of water was then added to the reaction vessel. A 2M solution of $AgNO_3$ and a 2M solution of NaCl were simultaneously run into the reaction vessel with rapid stirring, each at a flow rate of 249 ml/min. with controlled pAg of 7.51. The double jet precipitation continued for 21.5 minutes, after which the emulsion was cooled to 38° C., washed to a pAg of 7.26, and then concentrated. Additional gelatin was introduced to achieve 43.4 grams of gelatin/Ag mole, and the emulsion was adjusted to pH of 5.7 and pAg of 7.50. The resulting silver chloride emulsion had a cubic grain morphology and a 0.34 μm average edge length.

Emulsion F2 was prepared similarly as Emulsion F1, except as follows: During the precipitation, an iridium containing dopant was introduced via dissolution into the chloride stream in a way that introduced a total of 0.32 mppm of dopant MC-29a into the outer 93% to 95% of the grain volume. A shell of pure silver chloride (5% of the grain volume) was then precipitated to cover the doped band.

Emulsion F3 was precipitated as described for Emulsion F2, except that dopant MC-29a was added at a level of 0.16 ppm into the outer 93% to 95% of the grain volume.

Emulsion F4 was precipitated as described for Emulsion F2, except that dopant MC-34d was introduced at a total level of 0.32 mppm into the outer 93% to 95% of the grain volume. Analyses for iridium incorporation were performed by ICP-MS. The iridium levels in this emulsion were at least as high as those detected in a comparative emulsion doped with the conventional iridium dopant anions, $(IrCl_6)^{3-}$ or $(IrCl_6)^{2-}$.

Emulsion F5 was precipitated as described for Emulsion F2, except that dopant MC-34d was introduced at a total level of 0.10 mppm into the outer 93% to 95% of the grain volume.

Emulsion F6 was precipitated as described for Emulsion F2, except that MC-52 was introduced at a total level of 0.32 mppm into the outer 93% to 95% of the grain volume. Analyses for iridium incorporation were performed by ICP-MS. The iridium levels in this emulsion were at least as high as those detected in comparative emulsions prepared doped with the conventional iridium dopant anions, $(IrCl_6)^{3-}$ or $(IrCl_6)^{2-}$.

Emulsion F7 was precipitated as described for Emulsion F2, except that dopant MC-52 was introduced at a total level of 0.16 mppm into the outer 93% to 95% of the grain volume.

Emulsion F8 was precipitated as described for Emulsion F2, except that dopant MC-33 was introduced at a total level of 0.16 mppm into the outer 93% to 95% of the grain volume.

Emulsion F9 was precipitated as described for Emulsion F2, except that dopant MC-31a was introduced at a total level of 0.32 mppm into the outer 93% to 95% of the grain volume. The iridium levels in this emulsion were at least as high as those detected in a comparative emulsions doped with the conventional iridium dopant anions, $(IrCl_6)^{3-}$ or $(IrCl_6)^{2-}$.

Emulsion F10 was precipitated as described for Emulsion F2, except that dopant MC-31b was introduced at a total level of 0.32 mppm into the outer 93% to 95% of the grain volume.

Emulsion F11 was precipitated as described for Emulsion F2, except that dopant MC-31c was introduced at a total level of 0.32 mppm into the outer 93% to 95% of the grain volume.

Emulsion F12 was precipitated as described for Emulsion F2, except that dopant MC-53 was introduced at a total level of 0.32 mppm into the outer 93% to 95% of the grain volume.

Emulsion F13 was precipitated as described for Emulsion F2, except that dopant MC-54 was introduced at a total level of 0.32 mppm into the outer 93% to 95% of the grain volume.

Emulsion F14 was precipitated as described for Emulsion F2, except that dopant MC-14rr was introduced at a total level of 25 mppm into the outer 79.5% to 92% of the grain volume.

Emulsion F15 was precipitated as described for Emulsion F2, except that dopant MC-14rr was introduced at a total level of 43.7 mppm into the outer 7.9% to 95% of the grain volume. Analysis of this emulsion by ICP-AES showed that, within experimental error, the incorporated Fe level was the same as in similarly prepared emulsions doped with the conventional dopant anion $[Fe(CN)_6]^{4-}$.

Emulsion F16 was precipitated as described for Emulsion F2, except that EDTA (CD-1) was introduced as a dopant at a total level of 43.7 mppm into the outer 7.9% to 95% of the grain volume. Analysis of this emulsion by ICP-AES showed that the Fe level was less than the detection limit of this technique (3 mppm Fe in AgCl).

Emulsion F17 was precipitated as described for Emulsion F2, except that dopant Fe(EDTA)(CD-2) was introduced at a total level of 43.7 mppm into the outer 7.9% to 95% of the grain volume. Analysis of this emulsion by ICP-AES showed that the Fe level was less than the detection limit of this technique (3 mppm Fe in AgCl).

Emulsion F18 was precipitated as described for Emulsion F2, except that dopant $[Fe(CN)_6]^{4-}$ (CD-5) was introduced at a total level of 21.8 mppm into the outer 7.9% to 95% of the grain volume.

Emulsion F19 was precipitated as descrbied for Emulsion F2, except that dopant MC-14c was introduced through a third jet from a 0.1 molar aqueous $KClO_4$ solution and at a total level of 43.7 mppm into the outer 7.9% to 95% of the grain volume. The emulsion was studied by EPR spectroscopy, and the results were as described above in Example 1.

Emulsion F20 was precipitated as described for emulsion F2, except that dopant MC-52 was introduced at a total level of 21.8 mppm into the outer 7.9 to 95% of the grain volume. This emulsion was examined by EPR spectroscopy, as described in Example 1, in order to demonstrate the incorporation of organic ligands within the silver halide grain structure. Exposure of the emulsion F20 at between 180° and 240° K. produced a distinct EPR spectrum, with well resolved iridium and chlorine hyperfine structure. The spectrum could unequivocally be assigned to an iridium (II) ion at a silver position in the silver halide lattice. The EPR g-values were as follows: $g_1=2.911\pm0.001$, $g_2=2.634\pm0.001$, $g_3=1.871\pm0.001$. These are significantly different from those measured previously for $(IrCl_6)^{4-}$ in a AgCl matrix ($g_1=g_2=2.772\pm0.001$, $g_3=1.883\pm0.001$) or for $(IrCl_5H_2O)^{3-}$ in a AgCl matrix ($g_1=3.006\pm0.001$, $g_2=2.702\pm0.001$, $g_3\leqq2.0$. Since no EPR signals from these possible contaminants were observed in emuslion F20, it was concluded that the dopant complex MC-52, $(IrCl_5thiazole)^{2-}$, was incorporated intact. On exposure 9.7 $[IrCl_5(thiazole)]^{2-}$ trapped an electron to give $[IrCl_5(thiazole)]^{3-}$, which was detected by EPR.

Emulsion F21 was precipitated as described for emulsion F2, except that dopant MC-31a was introduced at a total level of 21.8 mppm into the outer 7.9 to 95% of the grain volume. The emulsion was examined by EPR spectroscopy, as described in Example 1. Exposure of emulsion F21 at 210° K. produced a distinctive EPR spectrum with well resolved indium and chlorine hyperfine structure. The spectrum could unequivocally be assgined to an iridium (II) ion at a silver position the silver halide lattice. The EPR parameters were as follows: $g_1=3.043\pm0.001$, $g_2=2.503\pm0.001$ and $g_3=1.823\pm0.005$. These were significantly different from those measured previously for $(IrCl_6)^{4-}$ or $(IrCl_5H_2O)^{3-}$ in a AgCl matrix (see parameters listed above). Since no EPR signatures from these possible contaminants were observed in emulsion F21, it was concluded that dopant complex MC-31a, $[IrCl_5(pyrazine)]^{2-}$, was incorporated intact. On exposure, $[IrCl_5(pyrazine)]^{2-}$ trapped an electron to give $[IrCl_5(pyrazine)]^{3-}$, which was detected by EPR.

The resulting emulsions were each divided into several portions.

Those portions designated portions (I) were chemically and spectrally sensitized by the addition of 30 mg/Ag mole of a colloidal dispersion of gold sulfide followed by digestion at 60° C. for 30 minutes. Following digestion each portion I was cooled to 40° and 300 mg/mole of 1-(3-acetamidophenyl)-5-mercaptotetrazola were added and held for 10 minutes, followed by 20 mg/mole of red spectral sensitizing dye anhydro-3-ethyl-9,11-neopentylene-3'-(3-sulfopropyl)thiadicarbocyanine hydroxide (Dye C) and a 20 minute hold.

Those portions designated portions (Ia) were treated as for portions (I), except that no dye was added and the final 20 minute hold was eliminated.

Those portions designated portions (II) were chemically and spectrally sensitized as described for portions (I), except that 50 rather than 30 mg/Ag mole of a colloidal dispersion of gold sulfide was added for each emulsion.

Those portions designated portions (III) were chemically and spectrally sensitized by the addition of aurous bis(1,4,5,-triazolium-1,2,4-trimethyl-3-thiolate) tetrafluoroborate, at 5, 7.5 or 10 mg per silver mole and di(carboxymethyl)-dimethyl thiourea, at 0.75 mg per silver mole followed by heat digestion and antifoggant and dye addition as described for portions (I).

Portions (IV) were chemically and spectrally sensitized by the addition of 8.4 mg/Ag mole of a colloidal dispersion of gold sulfide, followed by digestion at 30 minutes at 60° C. The emulsion was then treated as for portion I, except that 1.3 grams of KBr per silver mole were added prior to the dye addition.

PHOTOGRAPHIC COMPARISON

Sensitized portions (I, Ia, II and III) of the F series emulsions described above were coated onto cellulose acetate film support at 21.53 mg/dm$^2$ silver chloride and 53.92 mg/dm$^2$ gelatin. A gelatin overcoat layer comprised of 10.76 mg/dm$^2$ gelatin and a hardener, bis(vinylsulfonylmethyl) ether, at a level of 1.5% by wt., based of total gelatin. Samples of these coated photographic elements were evaluated by exposure for 1/10 second to 365 nm radiation, followed by development for 12 minutes in Kodak DK-50 TM developer. Additionally, samples of the coatings were evaluated for reciprocity failure by giving them a series of calibrated (total energy) white light exposures ranging from 1/10,000th of a second to 10 seconds, followed by development as above.

Sensitized portions (IV) of the F series emulsions described above were coated onto a photographic paper support at silver and gel levels of 1.83 and 8.3 mg/dm$^2$, respectively. A gelatin overcoat containing 4.2 mg/dm$^2$ of Coupler C1 and 1.5% by weight based on total gelatin of the hardener bis(vinylsulfonylmethyl) ether was applied over the emulsion.

Coupler C1

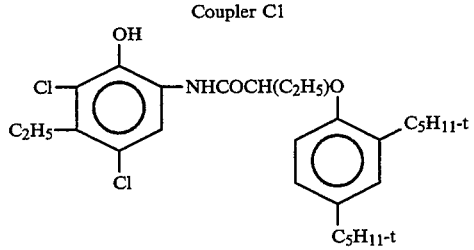

These coated photographic elements were evaluated by exposure for 1/10 second followed by development for 45 seconds in Kodak Ektacolor RA-4 TM developer.

Additionally, the coatings were evaluated for reciprocity by giving them a series of calibrated (total energy) white light exposures ranging from 1/10,000th of a second to 10 seconds, followed by development as above. In Tables F-I, F-II and F-III high intensity reciprocity failure (HIRF) and low intensity reciprocity failure (LIRF) are reported as the difference between relative log speeds times 100 measured a minimum density plus 0.15 optical density obtained at exposures of $10^{-4}$ and $10^{-1}$ second for HIRF and $10^{-1}$ and 10 seconds for LIRF. In all reciprocity failure investigations, regardless of the exact measurement points selected for comparison, ideal performance is for no speed difference—e.g., HIRF or LIRF are ideally zero or as near zero as attainable.

TABLE F-I

| Emulsion | Dopant | Sensitization | HIRF | LIRF |
|---|---|---|---|---|
| F1 | control | I | 24 | 21 |
| F2 | MC-29a | I | 12 | 17 |
| F3 | MC-29a | I | 14 | 19 |
| F5 | MC-34d | I | 10 | 14 |
| F6 | MC-52 | I | 0 | 6 |
| F7 | MC-52 | I | 2 | 14 |
| F8 | MC-33 | I | 14 | 15 |
| F9 | MC-31a | I | 3 | 20 |
| F10 | MC-31b | I | 14 | 18 |
| F11 | MC-31c | I | 15 | 19 |
| F12 | MC-53 | I | 2 | 19 |
| F13 | MC-54 | I | 23 | 22 |

TABLE F-II

| Emulsion | Dopant | Sensitization | HIRF | LIRF |
|---|---|---|---|---|
| F1 | control | II | 26 | 16 |
| F2 | MC-29a | II | 15 | 15 |
| F3 | MC-29a | II | 16 | 14 |

TABLE F-III

| Emulsion | Dopant | Sensitization | HIRF | LIRF |
|---|---|---|---|---|
| F1 | control | III, 10 mg/mole Au(I) salt | 19 | 13 |
| F5 | MC-34d | III, 10 mg/mole Au(I) salt | 13 | 9 |
| F7 | MC-52 | III, 5 mg/mole Au(I) salt | 1 | 5 |

TABLE F-IV

| Reciprocity Data for Format IV | | | | | |
|---|---|---|---|---|---|
| Emulsion | Dopant | Sensitization | Speed RF[a] | Shoulder Δ density[b] | Toe Δ density[c] |
| F1 | control | IV | −40 | −0.33 | 0.11 |
| F2 | MC-29a | IV | −36 | −0.05 | 0.04 |
| F4 | MC-34d | IV | −29 | −0.23 | 0.03 |
| F6 | MC-52 | IV | −27 | −0.23 | 0.07 |
| F7 | MC-52 | IV | −33 | −0.20 | 0.09 |
| F8 | MC-33 | IV | −27 | −0.38 | 0.13 |

[a]Speed RF is taken as the speed difference of equivalent exposures (intensity × time) of 0.1 and 100 sec duration. Zero is the ideal difference.
[b]Shoulder Δ density is the difference in density at a point 0.3 log E slow of the 1.0 optical density speed point for two equivalent exposures, the first of 0.1 sec duration and the second of 100 sec duration. Zero is the ideal difference.
[c]Toe Δ density is the difference in density at a point 0.3 log E fast of the 1.0 optical density speed point for two equivalent exposures, the first of 0.1 sec duration and the second of 100 sec duration. Zero is the ideal difference.

TABLE F-V

| Emulsion | Dopant | Sensitization | Dmin | Relative Log E (inertial) |
|---|---|---|---|---|
| F1 | control | I | 0.06 | 150 |
| F14 | MC-14rr | I | 0.04 | 164 |
| F16 | EDTA (CD-1) | I | 0.06 | 154 |
| F17 | $[Fe(EDTA)]^{1-}$ (CD-2) | I | 0.07 | 151 |
| F18 | $[Fe(CN)6]^{4-}$ (CD-5) | I | 0.06 | 161 |
| F1 | control | Ia | 0.06 | 167 |
| F14 | MC-14rr | Ia | 0.04 | 191 |
| F16 | CD-1 | Ia | 0.06 | 172 |
| F17 | CD-2 | Ia | 0.07 | 172 |
| F18 | CD-5 | Ia | 0.06 | 170 |

The photographic characteristics of emulsions F are given in Tables F-I, F-II, F-III, F-IV and F-V. For portions III, the best Au(I) level for each emulsion was chosen based on the photographic results and these are the results shown in Table F-III.

Tables F-I, F-II, F-III and F-IV show significant reductions in HIRF to be produced by the incorporation as a grain dopant of iridium complexes containing an acetonitrile, pyridazine, thiazole or pyrazine ligand. Additionally these complexes are capable of significantly reducing LIRF.

The results in Table F-IV show that an iron pentacyano complex containing an organic ligand is capable of producing performance characteristics in the emulsion that are superior to those obtained using an iron hexacyanide complex as a dopant. Further, it is demonstrated that EDTA used alone or as a ligand for iron does not produce the performance advantages demonstrated for the dopant satisfying the requirements of the invention.

G SERIES EXAMPLES

These examples demonstrate that ripening Lippmann silver bromide emulsions doped with coordination complexes satisfying the requirements of the invention onto silver chloride cubic grain emulsions produces doped emulsions with improved reciprocity, thermal stability and latent image keeping properties.

The series G emulsions used conventional precipitation techniques employing thioether silver halide ripening agents of the type disclosed in McBride U.S. Pat. No. 3,271,157.

Substrate Emulsion S1 was prepared as follows: A reaction vessel containing 8.5 liters of a 2.8% by weight gelatin aqueous solution and 1.8 grams of 1,8-dihydroxy-3,6-dithiaoctane was adjusted to a temperature of 68.3° C., pH of 5.8 and a pAg of 7.35 by addition of NaCl solution. A 3.75 molar solution containing 1658.0 grams of $AgNO_3$ in water and a 2.75 molar solution containing 570.4 grams of NaCl in water were simultaneously run into the reaction vessel with rapid stirring, each at a flow rate of 84 ml/min. The double jet precipitation continued for 31 minutes at a controlled pAg of 7.35. A total of 9.76 moles of silver chloride were precipitated, the silver chloride having a cubic morphology of 0.6 μm average cube length.

A series of Lippmann bromide carrier emulsions were prepared as a means of introducing the dopant complex into the emulsion grain during the chemical/spectral sensitization step.

Undoped Lippman control Emulsion L1 was prepared as follows: A reaction vessel containing 4.0 liters of a 5.6% by weight gelatin aqueous solution was adjusted to a temperature of 40° C., pH of 5.8 and a pAg of 8.86 by addition of AgBr solution. A 2.5 molar solution containing 1698.7 grams of $AgNO_3$ in water and a 2.5 molar solution containing 1028.9 grams of NaBr in water were simultaneously run into the reaction vessel with rapid stirring, each at a constant flow rate of 200 ml/min. The double jet precipitation continued for 3 minutes at a controlled pAg of 8.86, after which the double jet precipitation was continued for 17 minutes during which the pAg was decreased linearly from 8.86 to 8.06. A total of 10 moles of silver bromide (Lippmann bromide) was precipitated, the silver bromide having average grain sizes of 0.05 μm.

Emulsion L2 was prepared exactly as Emulsion L1, except a solution of 0.217 gram of $[IrCl_6]^{2-}$ (CD-3) in 25 ml water was added at a constant flow rate beginning at 50% and ending at 90% of the precipitation. This triple jet precipitation produced 10 moles of a 0.05 μm particle diameter emulsion.

Emulsion L3 was prepared exactly as Emulsion L1, except a solution of 0.528 gram of MC-31a in 25 ml water was added at a constant flow rate beginning at 50% and ending at 90% of the precipitation. This triple jet precipitation produced 10 moles of a 0.05 μm particle diameter emulsion.

Emulsion L4 was prepared exactly as Emulsion L1, except a solution of 0.488 gram of MC-33 in 25 ml water was added at a constant flow rate beginning at 50% and ending at 90% of the precipitation. This triple jet precipitation produced 10 moles of a 0.05 μm particle diameter emulsion.

Doped and chemically and spectrally sensitized emulsions were prepared as follows:

Control Emulsion G1 was prepared as follows: A 50 millimole (mmole) sample of Emulsion S1 was heated to 40° C. and spectrally sensitized by the addition of 14 milligrams (mg) of the blue spectral sensitizing dye, Dye D, anhydro-5-chloro-3,3'-di(3-sulfopropyl)naphtho[1,2-d]thiazolothiacyanine hydroxide triethylammonium salt.

This was followed by the addition of 0.45 mmoles of Emulsion L1. The temperature was raised to 60° C. to accelerate recrystallization of the Lippmann bromide onto the grain surfaces of Emulsion G1. To the emulsion were added 0.13 mg of sodium thiosulfate and 9.5 mg of 4-hydroxy-6-methyl-1,3,3a,7-tetraazaindene, and the emulsion was held at 60° C. for 30 to 50 minutes until optimal chemical sensitization was achieved. Addition of 1-(3-acetamidophenyl)-5-mercaptotetrazole followed to complete the finishing operation.

Comparative and example emulsions, identified in Table G-I, were prepared as described for emulsion G1, except that the 0.45 mole of Emulsion L1 used for emulsion G1 was replaced by equivalent amounts of a combination of emulsion L1 and emulsions L2, L3 or L4 as outlined in Table G-I.

TABLE G-I

Component Emulsions used in preparation of G Series Emulsions

| Emulsion | Total amount of Lippmann Emulsion (mmole) | Amount of L1 (mmole) | Amount of L# (mmole) | Dopant complex incorporated | Nominal Dopant level in Emulsion (mppm) |
|---|---|---|---|---|---|
| G2a comp. | 0.45 | 0.40 | 0.05, L2 | CD-3 | 5 |
| G2b comp. | 0.45 | 0.35 | 0.10, L2 | CD 3 | 10 |
| G2c comp. | 0.45 | 0.30 | 0.15, L2 | CD 3 | 15 |
| G3a inv. | 0.45 | 0.40 | 0.05, L3 | MC-31a | 5 |
| G3b inv. | 0.45 | 0.35 | 0.10, L3 | MC-31a | 10 |
| G3c inv. | 0.45 | 0.30 | 0.15, L3 | MC-31a | 15 |
| G4a inv. | 0.45 | 0.40 | 0.05, L4 | MC-33 | 5 |
| G4b inv. | 0.45 | 0.35 | 0.10, L4 | MC-33 | 10 |
| G4c inv. | 0.45 | 0.30 | 0.15, L4 | MC-33 | 15 |

The emulsions were coated on a photographic paper support as disclosed in U.S. Pat. No. 4,994,147 at 0.28 gram/m$^2$ silver with 0.002 gram/m$^2$ of 2,4-dihydroxy-4-methyl-1-piperidinocyclopenten-3-one and 0.02 gram/m$^2$ of KCl and 1.08 gram/m$^2$ yellow dye-forming coupler C2:

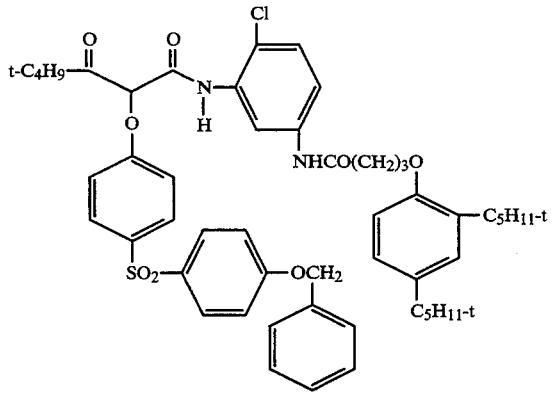

to give a layer with 0,166 gram/m$^2$ gelatin. A 1.1 gram/m$^2$ gelatin protective overcoat was applied along with a bisvinylsulfone gelatin hardener.

The coatings were exposed through a step tablet to a 3000° K. light source for various exposure times and processed as recommended in "Using KODAK EKTACOLOR RA Chemicals", Publication No. Z-130, published by Eastman Kodak Co., 1990, the disclosure of which is here incorporated by reference.

The photographic parameters obtained for these emulsions are shown in Tables G-II and G-III:

TABLE G-II

Speed, Reciprocity and Keeping Parameters for Emulsions G

| Emulsion # | Dopant complex incorporated in Emulsion G | Nominal Dopant level in Emulsion G (mppm) | Speed[a] for 100 sec exposure | Speed RF | Incubation Δ speed[b] |
|---|---|---|---|---|---|
| G1 control | none | 0 | 154 | −61 | 17 |
| G3a inv. | MC-31a | 5 | 135 | −44 | 14 |
| G3b inv. | MC-31a | 10 | 123 | −29 | 13 |
| G3c inv. | MC-31a | 15 | 116 | −30 | 14 |
| G4a inv. | MC-33 | 5 | 152 | −63 | 14 |
| G4b inv. | MC-33 | 10 | 147 | −57 | 19 |
| G4c inv. | MC-33 | 15 | 143 | −48 | 17 |

[a]Speed is based on the light exposure required to obtain an optical density of 1.0.
[b]Incubation Δ speed is the speed difference between a coating stored for 3 weeks at 49° C. and 50% relative humidity conditions and a check coating stored at −18° C. and 50% relative humidity conditions. Ideally the difference should be zero.

TABLE G-III

Heat Sensitivity and Latent Image Keeping Parameters for Emulsions G

| Emulsion # | Dopant complex incorporated in Emuls. G | Nominal Dopant level in Emuls. G (mppm) | Heat Sensitivity Δ[a] Speed[b] | Heat Sensitivity Δ[a] Toe[b,c] | Latent Image Keeping Δ[d] Speed[b] | Latent Image Keeping Δ[d] Toe[b,c] |
|---|---|---|---|---|---|---|
| G1 control | none | 0 | 25 | −0.06 | −2 | −0.02 |
| G2a comp. | CD-3 | 5 | 8 | 0 | 14 | −0.01 |
| G2b comp. | CD-3 | 10 | 8 | 0 | 23 | −0.09 |
| G2c comp. | CD-3 | 15 | 9 | −0.02 | 32 | −.12 |
| G3a inv. | MC-31a | 5 | 13 | −0.05 | 2 | −0.01 |
| G3b inv. | MC-31a | 10 | 9 | −0.01 | 1 | −0.01 |
| G3c inv. | MC-31a | 15 | 8 | −0.02 | 3 | −0.02 |
| G4a inv. | MC-33 | 5 | 20 | −0.09 | 1 | −0.02 |
| G4b inv. | MC-33 | 10 | 16 | −0.06 | 1 | −0.01 |
| G4c inv. | MC-33 | 15 | 11 | −0.03 | 2 | −0.01 |

[a]Heat sensitivity Δ measures the effect of temperature differences (40° C. versus 20° C.) at the time of exposure, taken as the difference in sensitometry.
[b]Speed and Toe measured for a 0.1 sec exposure
[c]Toe is the density of the sensitometric curve at an exposure scale value 0.3 log E less than that of the 1.0 optical density speed point.
[d]Latent Image keeping Change is the effect of delay time between exposure and processing, taken as the (30' vs. 30") difference in sensitometry.

The results in Tables G-II and G-III demonstrate that emulsions doped with coordination complexes containing iridium and pyrazine have improved reciprocity performance and, unlike comparison dopant $IrCl_6]^{2-}$ (CD-3), show good heat sensitivity and latent image keeping properties.

H SERIES EXAMPLES

These examples have as their purpose to demonstrate the effectiveness of coordination complexes of iridium and pyrazine ligands to reduce high and low intensity reciprocity failure in silver iodobromide tabular grain emulsions.

Each of the emulsions in this series contained $AgBr_{95.9}I_{4.1}$ tabular grains exhibiting a mean equivalent circular diameter of approximately 2.7 μm and a mean thickness of 0.13 μm.

Emulsion H1, an undoped control emulsion, was prepared as follows:

| | |
|---|---|
| Solution A: | |
| gelatin (bone) | 10 g |
| NaBr | 30 g |
| $H_2O$ | 5000 ml |
| Solution B: | |
| 0.393N $AgNO_3$ | 514 ml |
| Solution C: | |
| 2N NaBr | 359 ml |
| Solution D: | |
| 0.1286N $(NH_4)_2SO_4$ | 350 ml |
| Solution E: | |
| 2.5N NaOH | 40 ml |
| Solution F: | |
| 4N HNO3 | 25 ml |
| Solution G: | |
| gelatin (bone) | 140.14 g |
| $H_2O$ | add to 1820 ml |
| Solution H: | |
| 2.709N NaBr | |
| 0.0413N KI | |
| Solution I: | |
| 2.75N $AgNO_3$ | 4304 ml |
| Solution J: | |
| 4.06N NaBr | 720 ml |
| Solution K: | |
| AgI | 0.36 mole |
| $H_2O$ | 760 ml |

Solution A was added to a reaction vessel. The pH of the reaction vessel was adjusted to 6 at 40° C. The temperature was raised to 65° C. and solutions B and C were added at rates of 64 ml/min and 15.3 ml/min, respectively for 1 min. Solutions D, E, F and G were then added consecutively. Solutions B and H were added at rates of 87 ml/min and 13.9 ml/min for 5 min while pAg was controlled at 9.07.

Solutions I and C were added, with continued pAg control, for the rates and times given below:

| Step | Solution I flow rate (ml/min) | Solution C flow rate (ml/min) | Time (min) |
|---|---|---|---|
| a | 15 increasing linearly to 40 | 16.2 increasing linearly to 42 | 25 |
| b | 40 increasing linearly to 98.1 | 42.2 increasing linearly to 102.3 | 31 |
| c | 100 | 104.7 | 1.5 |

Solutions J and K were then added consecutively. Solution I was then added at a rate of 50 ml/min over 24 min and solution C was used to control the pAg at 8.17. The emulsion was cooled to 40° C., washed to reach a pAg of 8.06 and concentrated.

Doped Emulsion H2 was prepared as described above, except that dopant MC-53 was introduced into the reaction vessel from an aqueous solution in the first part of step c. Dopant MC-53 was added in an amount needed to give a total dopant concentration of 0.025 mppm.

Doped Emulsion H3 was prepared as described above, except that dopant MC-33 was introduced into the reaction vessel from an aqueous solution in the first part of step c. Dopant MC-33 was added in an amount needed to give a total dopant concentration of 0.013 mppm.

Dope Emulsion H4 was prepared as described above, except that dopant MC-52 was introduced into the reaction vessel from an aqueous solution in the first part of step c. Dopant MC-33 was added in an amount needed to give a dopant concentration of 0,025 mppm.

Samples of emulsions H1 to H3 were sensitized by melting at 40° C., adding NaSCN at 100 mg/Ag mole, adding benzothiazolium tetrafluoroborate finish modifier at 30 mg/Ag mole, adding green sensitizing dyes Dye E and Dye F in an amount sufficient to provide from 65%–80% monolayer dye coverage in a 3:1 molar ratio of Dye E:Dye F, adding gold sensitizer in the form of sodium aurous (I) dithiosulfate dihydrate at 1.75 mg/Ag mole, adding sulfur sensitizer in the form of sodium thiosulfate at 0.87 mg/Ag mole. This mixture was then brought to 60° C. and held for 7 min. then chill set. Dye E was anhydro-5-chloro-9-ethyl-5'-phenyl-3'-(3-sulfobutyl)-3-(sulfopropyl)oxacarbocyanine hydroxide, sodium salt. Dye F was anhydro-6,6'-dichloro-1,1'-diethyl-3,3'-bis(3-sulfopropyl)-5,5'-bis(trifluoromethyl)-benzimidazole carbocyanine hydroxide, sodium salt.

The sensitized emulsion was combined with a coupler melt made up to provide a coating lay down of 53.82 mg/dm$^2$ gelatin, 21.53 mg/dm$^2$ Ag, 7.5 mg/dm$^2$ dye-forming coupler C3 and 1.75 g/Ag mole 5-methyl-s-triazole-[2-3-a]-pyrimidine-7-ol sodium salt onto a cellulose acetate photographic film support. The support had been previously coated with 3.44 mg/dm$^2$ Ag for antihalation and a 24.4 mg/dm$^2$ gelatin pad. The coupler containing emulsion layer was overcoated with 9.93 mg/dm$^2$ gelatin and bis-(vinylsulfonylmethyl) ether hardener at 1.75% by weight, based on gelatin.

Coupler C3

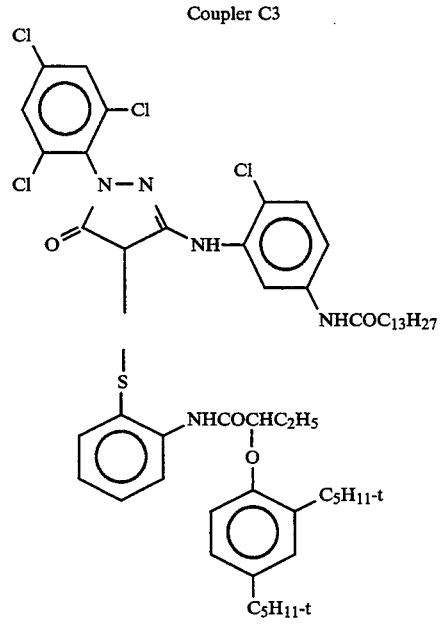

The coated photographic film samples were evaluated for reciprocity response by giving them a series of calibrated (total energy) exposures ranging from 1/10,000th of a second to 10 seconds, followed by development for 6 minutes in Kodak KRX TM developer, a hydroquinone-Elon TM (N-methyl-p-aminopenol hemisulfate) developer.

The results are tabulated in Tables H-I and H-II.

TABLE H-I

Reciprocity Response for Emulsions H

| Emulsion | Dopant | HIRF[a] | LIRF[b] |
|---|---|---|---|
| H1 | none | 15 | 46 |

TABLE H-I-continued

| | | | |
|---|---|---|---|
| H2 | MC-53 | −8 | 23 |

TABLE H-II

Reciprocity Response for Emulsions H

| Emulsion | Dopant | LIRF[b] |
|---|---|---|
| H1 | none | 45 |
| H3 | MC-33 | 26 |

[a]difference between relative log speeds times 100 obtained at 0.1 and $10^{-4}$ sec duration equivalent exposures, measured at optical density = 0.75 above Dmin. The ideal value is zero.
[b]difference between relative log speeds times 100 obtained at 0.1 and 10 sec duration equivalent exposures, measured at optical density = 0.15 above Dmin. The ideal value is zero.

The reciprocity results demonstrate that iridium coordination complexes containing a pyrazine ligand were effective in reducing reciprocity failure, particularly low intensity reciprocity failure.

Portions of the undoped control emulsion H1 and the MC-52 doped example emulsion H4 were melted at 40° C., followed by adding NaSCN 120 mg/Ag mole, adding red spectral sensitizing dyes Dye G, anhydro-5,5'-dichloro-9-ethyl-3,3'-di(3-sulfopropyl)thiacarbocyanine hydroxide, and Dye H, anhydro-9-ethyl-5,5'-dimethyl-3,3'-di(3- sulfopropyl)-thiacarbocyanine hydroxide, triethyl amine salt, in an amount sufficient to provide 65 to 80% of monolayer dye coverage in a 9:1 molar ratio of Dye G:Dye H, adding gold sensitizer in the form of dithiosulfate dihydrate at 1.75 mg/Ag mole, adding sulfur sensitizer in the form of sodium thiosulfate at 3.5 mg/Ag mole, adding 20 mg/Ag mole of benzothiazolium tetrafluoroborate finish modifier. This mixture was brought to 60° C. and held for 20 min.

The sensitized emulsion portions were combined with a coupler melt made up to provide a coating laydown of 32.29 mg/dm$^2$, 10.76 mg/dm$^2$ Ag, 9.69 mg/dm$^2$ dye-forming coupler C4 onto a cellulose acetate photographic support.

Coupler C4

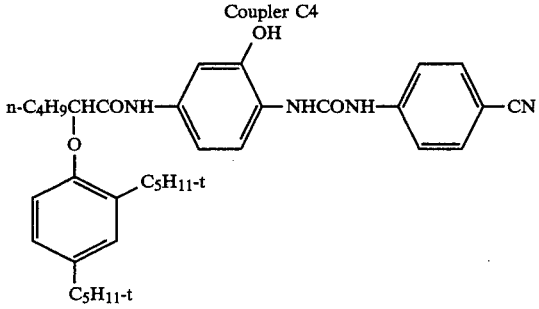

The support had been previously coated with 3.44 mg/dm$^2$ Ag for antihalation and a 24.4 mg/dm$^2$ gelatin pad. The coupler containing emulsion layer was overcoated with 9.93 mg/dm$^2$ gelatin and bis(vinylsulfonylmethyl) ether hardener at 1.75% by weight, based on gelatin.

The coated photographic film samples were evaluated for reciprocity response by giving them a series of calibrated (total energy) exposures ranging from 1/100,000th of a second to 1 second, followed by development for 2 minutes 15 seconds in Kodak Flexicolor C-41 TM developer.

TABLE H-III

Reciprocity Response for Emulsions H

| Emulsion | Dopant | LIRF[c] |
|---|---|---|
| H5 | none | 24 |
| H4 | MC-52 | 13 |

[c]difference between relative log speeds times 100 obtained at 0.1 and 10 sec duration equivalent exposures, measured at optical density = 0.15 above Dmin. The ideal value is zero.

I SERIES EXAMPLES

This series of examples is provided to demonstrate the effectiveness of iridium coordination complexes containing an oxalate ligand to increase photographic speed. The comparisons demonstrate that when more than half of the metal coordination sights are occupied by oxalate ligands no significant speed increase was realized.

The emulsions prepared for comparison in this example series were silver bromide regular octahedra that were doped by pAg cycling to produce a thin shell of doped silver bromide on the surface of the host grains.

Emulsion I1 A monodispersed one μm edge-length octahedral AgBr emulsion was prepared by the double-jet technique described in Example series A, modified to produce the larger grain size by the presence of 500 mppm of the ripening agent 1,10-dithia-4,7,13,16-tetraoxacyclooctadecane in the reaction vessel at the start of precipitation.

The emulsion was divided into 28 portions. These were sensitized with dopant salts of the series $[IrCl_{6-2n}(C_2O_4)_n]^{3-}$ (n=1, MC-35; n-2, CD-7; and n=3, CD-8) as well as with $K_2C_2O_4.H_2O$ (CD-4) as follows: The pAg of the emulsion, measured at 40° C. was increased from 8.2 to 9.8 by the addition of 1.5 mole % NaBr (aq). The dopant salt was added from dilute aqueous solution in the amounts described in Table I-I. The emulsion was held at 40° C. for 15 minutes. Aqueous $AgNO_3$ was added in the amount of 1.5 mole %. The emulsion was held 15 minutes and then chilled. This procedure was designed to bury the dopant complex within a thin shell of AgBr.

The emulsion resulting from the above procedure was coated at 26.9 mg/dm$^2$ Ag and 75.35 mg/dm$^2$ gelatin on a cellulose acetate photographic film support. The resulting photographic element was exposed for 1/10th second to a 5500° K. color temperature light source through a graduated density filter and developed for 12 minutes in Kodak Rapid X-Ray TM developer, a hydroquinone-Elon TM (N-methyl-p-aminophenol hemisulfate) developer.

The photographic sensitivity imparted by these complexes is given in the Table I-I below:

TABLE I-I

Difference in Log Relative Speed times 100, between Doped (pAg cycled) Emulsion I1 and Undoped Control.

| Dopant # | Level (mppm) | (Δ Log E) × 100 |
|---|---|---|
| none-control i | 0 | 0 |
| none-control ii | 0 | −10 |
| none-control iii | 0 | 12 |
| MC-35 | 100 | 40 |
| " | 20 | 79 |
| " | 4 | 107 |
| " | 0.8 | 81 |
| " | 0.16 | 13 |
| " | 0.032 | −11 |
| " | 0.0064 | −4 |
| " | 0.0013 | 0 |
| CD-7 | 100 | −1 |
| " | 20 | −25 |

TABLE I-I-continued

| Difference in Log Relative Speed times 100, between Doped (pAg cycled) Emulsion I1 and Undoped Control. | | |
|---|---|---|
| Dopant # | Level (mppm) | (Δ Log E) × 100 |
| " | 4 | −3 |
| " | 0.8 | −3 |
| " | 0.16 | −1 |
| " | 0.032 | 10 |
| CD-8 | 100 | −7 |
| " | 20 | −4 |
| " | 4 | −6 |
| " | 0.8 | 2 |
| " | .16 | −5 |
| CD-4 | 100 | 0 |
| " | 20 | 8 |
| " | 4 | 0 |
| " | .8 | 2 |
| " | .16 | 13 |
| " | .032 | 14 |
| " | .0064 | −1 |
| " | .0013 | 9 |

As can be seen from Table I-I, only the monooxalate complex (MC-35) showed any significant increase in photographic speed.

The invention has been described in detail with particular reference to preferred embodiments thereof, but it will be understood that variations and modifications can be effected within the spirit and scope of the invention.

What is claimed is:

1. A photographic silver halide emulsion comprised of radiation sensitive silver halide grains exhibiting a face centered cubic crystal lattice structure containing a hexacoordination complex of a metal chosen from groups 8 and 9 of the periodic table of elements in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands.

2. A photographic silver halide emulsion according to claim 1 wherein the silver halide grains are chosen from among silver bromide, silver iodobromide, silver chloride, silver chlorobromide, silver bromochloride, silver iodochloride, silver iodobromochloride and silver iodochlorobromide grains.

3. A photographic silver halide emulsion according to claim 2 wherein the organic ligands contain up to 18 nonmetal atoms.

4. A photographic silver halide emulsion according to claim 3 wherein at least one of the organic ligands is comprised of a 5 or 6 membered heterocyclic ring.

5. A photographic silver halide emulsion according to claim 4 wherein the heterocyclic ring contains from 1 to 3 nitrogen heterocyclic ring atoms.

6. A photographic silver halide emulsion according to claim 5 wherein the heterocyclic ring is chosen from among azole, diazole, triazole, tetrazole, triazologuinoline, pyridine, bipyridine, pyrazine, pyridazine and pyrene moieties.

7. A photographic silver halide emulsion according to claim 4 wherein the metal is cobalt and a pseudohalide dopant is also present having a Hammett sigma value more positive than 0.50.

8. A photographic silver halide emulsion according to claim 1 wherein the organic ligands contain up to 24 nonmetal atoms.

9. A photographic silver halide emulsion according to claim 1 wherein the organic ligands are selected from among substituted and unsubstituted aliphatic and aromatic hydrocarbons, amines, phosphines, amides, imides, nitriles, aldehydes, ethers, ketones, organic acids, sulfoxides, and aliphatic and aromatic heterocycles including one or a combination of chalcogen and pnictide hetero ring atoms.

10. A photographic silver halide emulsion according to claim 1 wherein the metal is chosen from among iron, ruthenium, rhodium and iridium.

11. A photographic silver halide emulsion according to claim 1 wherein the metal is a period 4 element.

12. A photographic silver halide emulsion according to claim 1 wherein the metal is a period 5 element.

13. A photographic silver halide emulsion according to claim 1 wherein the metal is a period 6 element.

14. A photographic silver halide emulsion according to claim 1 which includes a spectral sensitizing dye.

15. A photographic silver halide emulsion comprised of radiation sensitive silver halide grains exhibiting a face centered cubic crystal lattice structure containing a hexacoordination or tetracoordination complex of a metal chosen from periods 4, 5 and 6 of groups 3 to 14 of the periodic table of elements in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands, wherein at least one organic ligand is comprised of a 5 or 6 membered heterocylic ring that contains at least one sulfur heterocyclic ring atom.

16. A photographic silver halide emulsion comprised of radiation sensitive silver halide grains exhibiting a face centered cubic crystal lattice structure containing a hexacoordination or tetracoordination complex of a metal chosen from periods 4, 5 and 6 of groups 3 to 14 of the periodic table of elements in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands, wherein at least one organic ligand is comprised of a heterocylic ring that is an azole ring containing a chalcogen atom and a nitrogen atom.

17. A photographic silver halide emulsion according to claim 16 wherein the heterocyclic ring is an oxazole, thiazole, selenazole or tellurazole ring.

18. A photographic silver halide emulsion comprised of radiation sensitive silver halide grains exhibiting a face centered cubic crystal lattice structure containing a hexacoordination or tetracoordination complex of a metal chosen from periods 4, 5 and 6 of groups 3 to 14 of the periodic table of elements in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands, wherein at least one organic ligand is an aliphatic azahydrocarbon.

19. A photographic silver halide emulsion according to claim 18 wherein the aliphatic azahydrocarbon is a diamine.

20. A photographic element comprised of radiation-sensitive silver halide grains exhibiting a face centered cubic crystal lattice structure containing a hexacoordination complex of a metal chosen from periods 4, 5 and 6 of groups 8 and 9 of the periodic table of elements in which one or more organic ligands each containing at least one carbon-to-carbon bond, carbon-to-hydrogen bond, or carbon-to-nitrogen-to-hydrogen bond sequence occupy up to half the metal coordination sites in the coordination complex and at least half of the metal coordination sites in the coordination complex are provided by halogen or pseudohalogen ligands, wherein at least one organic ligand is a nitrile.

21. A photographic silver halide emulsion according to claim 20 wherein the nitrile is acetonitrile or benzonitrile.

22. A photographic silver halide emulsion comprised of radiation sensitive silver halide grains exhibiting a face centered cubic crystal lattice structure containing a hexacoordination or tetracoordination complex of a metal chosen from periods 4, 5 and 6 of groups 3 to 14 of the periodic table of elements in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands, wherein at least one organic ligand is an aliphatic sulfoxide.

23. A photographic silver halide emulsion according to claim 22 wherein the aliphaticsulfoxide ligand is dialkylsulfoxide.

24. A photographic silver halide emulsion comprised of radiation sensitive silver halide grains exhibiting a face centered cubic crystal lattice structure containing a hexacoordination or tetracoordination complex of a metal chosen from periods 4, 5 and 6 of groups 3 to 14 of the periodic table of elements in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands, wherein at least one organic ligand is a dicarboxylate.

25. A photographic silver halide emulsion according to claim 24 wherein the dicarboxylate ligand is an oxalate.

26. A photographic silver halide emulsion comprised of radiation sensitive silver halide grains exhibiting a face centered cubic crystal lattice structure containing a hexacoordination or tetracoordination complex of rhodium present in a concentration sufficient to increase contrast in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands.

27. A photographic silver halide emulsion comprised of radiation sensitive silver halide grains exhibiting a face centered cubic crystal lattice structure containing a hexacoordination or tetracoordination complex of a group 8 metal in which one or more organic ligands each containing at least one carbon-to-carbon bond, at least one carbon-to-hydrogen bond or at least one carbon-to-nitrogen-to-hydrogen bond sequence occupy up to half the metal, coordination sites in the coordination complex and at least half of the metal coordination sites in the coordination complex are provided by halogen or pseudohalogen ligands, wherein a pseudohalide ligand is present having a Hammett sigma value more positive than 0.50.

28. A photographic silver halide emulsion comprised of radiation sensitive silver halide grains containing greater than 50 mole percent chloride exhibiting a face centered cubic crystal lattice structure containing a hexacoordination or tetracoordination complex of a group 8 metal in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands, wherein at least one organic ligand is an aliphatic sulfoxide.

29. A photographic silver halide emulsion comprised of radiation sensitive silver halide grains containing greater than 50 mole percent bromide exhibiting a face centered cubic crystal lattice structure containing a hexacoordination or tetracoordination complex of a group 8 metal in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands, wherein at least one organic ligand is an aliphatic sulfoxide.

30. A photographic silver halide emulsion comprised of radiation sensitive silver halide grains exhibiting a face centered cubic crystal lattice structure containing a hexacoordination or tetracoordination complex of iridium in which one or more organic ligands each containing at least one carbon-to-carbon bond, at least one carbon-to-hydrogen bond or at least one carbon-to-nitrogen-to-hydrogen bond sequence occupy up to half the metal coordination sites in the coordination complex and at least half of the metal coordination sites in the coordination complex are provided by halogen or pseudohalogen ligands, wherein at least one organic ligand is an aromatic heterocyclic moiety.

31. A process of preparing a radiation-sensitive silver halide emulsion comprising reacting silver and halide ions in a dispersing medium in the presence of a metal hexacoordination complex having at least one organic ligand containing at least one carbon-to-carbon bond, carbon-to-hydrogen bond, or carbon-to-nitrogen-to-hydrogen bond sequence and at least half of the metal coordination sites occupied by halide or pseudohalide ligands, the metal forming the complex being chosen from periods 4, 5 and 6 and groups 8 and 9 of the periodic table of elements.

32. A process of preparing a radiation-sensitive silver halide emulsion according to claim 31 wherein the halide ions are chosen to form silver bromide, silver iodobromide, silver chloride, silver chlorobromide, silver bromochloride, silver iodochloride, silver iodobromochloride or silver iodochlorobromide grains.

33. A process of preparing a radiation-sensitive silver halide emulsion according to claim 31 wherein the organic ligand contains up to 24 nonmetal atoms.

34. A process of preparing a radiation-sensitive silver halide emulsion according to claim 31 wherein the organic ligands are selected from among substituted and unsubstituted aliphatic and aromatic hydrocarbons, amines, phosphines, amides, imides, nitriles, aldehydes, ketones, ethers, organic acids, sulfoxides, and aliphatic and aromatic heterocycles including one or a combination of chalcogen and pnictide hetero ring atoms.

35. A process of preparing a radiation-sensitive silver halide emulsion according to claim 31 wherein the metal is chosen from among group 8 metals.

36. A process of preparing a radiation-sensitive silver halide emulsion according to claim 31 wherein the metal is chosen from among iron, cobalt, ruthenium, rhodium and iridium.

37. A process of preparing a radiation-sensitive silver halide emulsion comprising reacting silver and halide ions in a dispersing medium in the presence of a pentacyano iron coordination complex containing a pyridine, pyrazine, pyrazole or 4,4'-bipyridine ligand.

38. A process of preparing a radiation-sensitive silver halide emulsion comprising reacting silver and halide ions in a dispersing medium in the presence of a pentacyano iron or ruthenium coordination complex containing a dimethylsulfoxide ligand.

39. A process of preparing a radiation-sensitive silver halide emulsion comprising reacting silver and halide ions in a dispersing medium in the presence of a pentacyano ruthenium or osmium coordination complex containing a pyridine, pyrazine, pyrazole or 4,4'-bipyridine ligand.

40. A process of preparing a radiation-sensitive silver halide emulsion comprising reacting silver and halide ions in a dispersing medium in the presence of an iridium coordination complex containing chloride ligands and from 1 to 3 pyrazine or pyridine ligands.

41. A process of preparing a radiation-sensitive silver halide emulsion comprising reacting silver and halide ions in a dispersing medium in the presence of an iridium coordination complex containing an oxalato ligand.

42. A process of preparing a radiation-sensitive silver halide emulsion comprising reacting silver and halide ions in a dispersing medium in the presence of an iridium coordination complex containing one or two acetonitrile ligands.

43. A process of preparing a radiation-sensitive silver halide emulsion comprising reacting silver and halide ions in a dispersing medium in the presence of a cobalt coordination complex containing an ethylenediamine ligand.

44. A process of preparing a radiation-sensitive silver halide emulsion comprising reacting silver and halide ions in a dispersing medium in the presence of an iridium coordination complex containing a thiazole ligand.

45. A process of preparing a radiation-sensitive silver halide emulsion comprising reacting silver and halide ions in a dispersing medium in the presence of a pentacyano rhodium coordination complex containing a pyridine, pyrazine, pyrazole or 4,4'-bipyridine ligand.

46. A process of preparing a radiation-sensitive silver halide emulsion comprising reacting silver and halide ions in a dispersing medium in the presence of an iron coordination complex containing a triazoloquinoline ligand.

* * * * *